US009658551B2

(12) United States Patent
Terui et al.

(10) Patent No.: US 9,658,551 B2
(45) Date of Patent: May 23, 2017

(54) TONER

(71) Applicant: CANON KABUSHIKI KAISHA, Tokyo (JP)

(72) Inventors: Yuhei Terui, Numazu (JP); Katsuyuki Nonaka, Mishima (JP); Koji Abe, Numazu (JP); Harumi Takada, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 245 days.

(21) Appl. No.: 14/509,250

(22) Filed: Oct. 8, 2014

(65) Prior Publication Data

US 2015/0099222 A1 Apr. 9, 2015

(30) Foreign Application Priority Data

Oct. 9, 2013 (JP) ..... 2013-212261

(51) Int. Cl.
*G03G 9/087* (2006.01)
*G03G 9/093* (2006.01)
*G03G 9/08* (2006.01)

(52) U.S. Cl.
CPC ..... *G03G 9/08791* (2013.01); *G03G 9/0825* (2013.01); *G03G 9/08708* (2013.01); *G03G 9/08755* (2013.01); *G03G 9/09321* (2013.01)

(58) Field of Classification Search
CPC ..... G03G 9/09321; G03G 9/09328; G03G 9/09392; G03G 9/09775; G03G 9/0825; G03G 9/08791; G03G 9/08708; G03G 9/08755
USPC ..... 430/110.2, 108.3, 109.4
See application file for complete search history.

(56) References Cited

U.S. PATENT DOCUMENTS

| | | | | |
|---|---|---|---|---|
| 6,358,658 | B1 | 3/2002 | Tazawa et al. | |
| 8,247,147 | B2 | 8/2012 | Abe et al. | |
| 2010/0159376 | A1 | 6/2010 | Zhou et al. | |
| 2014/0186761 | A1* | 7/2014 | Abe | G03G 9/09775 430/108.3 |

FOREIGN PATENT DOCUMENTS

| | | | |
|---|---|---|---|
| JP | 9-179341 | A | 7/1997 |
| JP | 2001-75304 | A | 3/2001 |
| JP | 2006-146056 | A | 6/2006 |
| JP | 5084482 | B2 | 11/2012 |

OTHER PUBLICATIONS

U.S. Appl. No. 14/509,257, filed Oct. 8, 2014. Inventor: Koji Abe, et al.
U.S. Appl. No. 14/509,239, filed Oct. 8, 2014. Inventor: Koji Abe, et al.

* cited by examiner

*Primary Examiner* — Janis L Dote
(74) *Attorney, Agent, or Firm* — Fitzpatrick Cella Harper and Scinto

(57) ABSTRACT

The present invention provides a toner having a toner particle that contains a binder resin, wherein the binder resin contains a vinylic resin and a polyester resin, the vinylic resin contains an organic silicon polymer having a specific structure, the organic silicon polymer is contained in the surface layer of the toner particle, the proportion of a silicon atom in the organic silicon polymer having a specific structure is at least 5%, the polyester resin is a specific polymer, and the toner particle contains a specific amount of the polyester resin.

10 Claims, 3 Drawing Sheets

TONER

BACKGROUND OF THE INVENTION

Field of the Invention

The present invention relates to a toner for developing electrostatic images (electrostatic latent images) used in image-forming methods in the manner of electrophotography and electrostatic printing.

Description of the Related Art

Due to the development of computers and multimedia in recent years, there is a desire for a means of outputting high-definition full-color images in a wide range of fields from the office to the home.

In addition, there is a demand for high durability without decreasing quality even when copying or printing large numbers of prints during use in offices where copying or printing is carried out frequently. On the other hand, in the case of use in small offices or at home, image-forming apparatuses are being required to be more compact in addition to allowing the obtaining of high-quality images from the viewpoints of saving on space, saving on energy and reducing weight. In order to response to these demands, there is a need to further improve toner performance in terms of environmental stability, resistance to contamination of members, low-temperature fixability, development durability and storage stability.

In the case of full-color images in particular, images are formed by superimposing color toners, and color reproducibility decreases and uneven coloring ends up occurring unless each color of toner is developed in the same way. The effect on development becomes large as a result of the pigment or dye used as toner colorant precipitating on the surface of the toner particles.

Moreover, fixing performance and color mixability during fixation are important when forming full-color images. Although a binder resin suitable for low-temperature fixability is selected in order to achieve a desired increase in speed, the effects of this binder resin on developability and durability are also considerable.

One example of a factor responsible for fluctuations in toner storage stability or amount of electric charge caused by temperature and humidity is the occurrence of a phenomenon in which toner release agent and resin components exude from inside toner particles onto the surface (to also be referred to as bleeding), and this bleeding causes a change in the surface properties of toner particles.

A method consisting of covering the surface of toner particles with resin is one method for solving such problems.

Japanese Patent Application Laid-open No. 2006-146056 discloses a toner that strongly adheres inorganic fine particles to the surface thereof as a toner that demonstrates superior high-temperature storability as well as printing durability in normal temperature, normal humidity environments and high temperature, high humidity environments during image output.

However, even though inorganic fine particles are strongly adhered to the toner particles, there is a need for further improvement with respect to durability and contamination of members in harsh environments due to the occurrence of bleeding caused by the release agent and resin composition from the gaps between inorganic fine particles, and the release of inorganic fine particles due to deterioration of with time.

In addition, Japanese Patent Application Laid-open No. H03-089361 discloses a method for producing a polymerized toner obtained by adding a silane coupling agent to the reaction system in order to obtain a toner having a narrow charge distribution and little charge humidity-dependency without exposing colorant or polar substances on the surface of the toner particles.

However, in this method, since the amount of silane compound that precipitates on the surface of the toner particles and hydrolysis and condensation polymerization of the silane compound are inadequate, further improvement is required with respect to environmental stability and development durability.

Moreover, Japanese Patent Application Laid-open No. H09-179341 discloses a method for using a polymerized toner containing a silicon compound provided in the form of a continuous thin film on a surface portion as a method for controlling the amount of toner charge and forming high-quality output images without being influenced by temperature or humidity.

However, due to the large polarity of the organic functional groups, the amount of silane compound that precipitates on the surface of the toner particles and hydrolysis and condensation polymerization of the silane compound are inadequate, the degree of crosslinking is weak, and further improvement is required with respect to changes in image density caused by changes in charging performance at high temperature and high humidity as well as contamination of members caused by deterioration with time.

Moreover, Japanese Patent Application Laid-open No. 2001-75304 discloses a polymerized toner having a coated layer formed by mutually adhering blocks of particles containing a silicon compound as a toner for improving flowability, release of fluidizing agent, low-temperature fixability and blocking.

However, bleeding attributable to release agent and resin components from gaps between clumps of particles containing silicon compounds occurred easily. In addition, the amount of silane compound precipitating on the surface of the toner particles and hydrolysis and condensation polymerization of the silane compound were inadequate, thereby requiring further improvement with respect to changes in image density caused by changes in charging performance at high temperature and high humidity as well as contamination of members caused by melt adhesion of toner.

On the other hand, the use of a crystalline resin for the binder resin has been proposed as a means of realizing low-temperature fixability while satisfying storage stability.

For example, Japanese Patent No. 5084482 discloses a means of realizing both low-temperature fixability and long-term storability by combining the use of crystalline polyester and amorphous polyester containing an aliphatic alkyl segment for use as a binder resin.

However, it was still necessary to slightly improve long-term storability in order to achieve additional low-temperature fixability.

SUMMARY OF THE INVENTION

The present invention provides a toner having superior storage stability, low-temperature fixability, environmental stability, development durability and resistance to contamination of members.

The present invention provides a toner comprising a toner particle that contains a binder resin, wherein the binder resin contains a vinylic resin and a polyester resin, the vinylic resin contains an organic silicon polymer having a partial structure represented by the following formula (1) or the following formula (2):

[Chemical Formula 1]

formula (1)

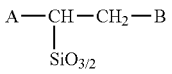

formula (2)

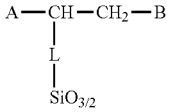

(wherein, A and B respectively and independently represent a partial structure represented by the following formula (3) or the following formula (4), and in formula (2),Lrepresents a methylene group, ethylene group or phenylene group),

[Chemical Formula 2]

formula (3)

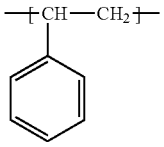

formula (4)

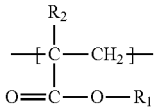

(wherein, $R_1$ represents a hydrogen atom or alkyl group (aliphatic alkyl group) having from 1 to 22 (both inclusive) carbon atoms and $R_2$ represents a hydrogen atom or methyl group), the surface layer (top layer, outermost layer) of the toner particle contains the organic silicon polymer, a proportion of a silicon atom in the organic silicon polymer having a structure represented by the $—SiO_{3/2}$ relative to a silicon atom in the organic silicon polymer contained in the toner particle is at least 5%, the polyester resin contains at least one polymer selected from the group consisting of polymers indicated in the following (i), (ii) and (iii):

(i) a polymer obtained by condensation polymerization of an alcohol component containing at least 50.0 mol % of an aliphatic diol having from 2 to 16 (both inclusive) carbon atoms, and a carboxylic acid component containing at least 50.0 mol % of an aliphatic dicarboxylic acid having from 2 to 16 (both inclusive) carbon atoms, (ii) a polymer obtained by condensation polymerization of an alcohol component containing at least 50.0 mol % of an aliphatic diol having from 2 to 16 (both inclusive) carbon atoms, and a carboxylic acid component containing at least 50.0 mol % of an aromatic dicarboxylic acid having from 8 to 18 (both inclusive) carbon atoms, and (iii) a polymer obtained by condensation polymerization of an alcohol component containing at least 50 mol % of an aromatic diol and a carboxylic acid component containing at least 50.0 mol % of an aliphatic dicarboxylic acid having from 2 to 16 (both inclusive) carbon atoms, and the toner particle contains from at least 3.0% by mass to not more than 70.0% by mass of the polyester resin based on the binder resin contained in the toner particle.

According to the present invention, a toner can be provided that has superior storage stability, low-temperature fixability, environmental stability, development durability and resistance to contamination of members.

Further features of the present invention will become apparent from the following description of exemplary embodiments (with reference to the attached drawings).

DESCRIPTION OF THE EMBODIMENTS

Figure 1:
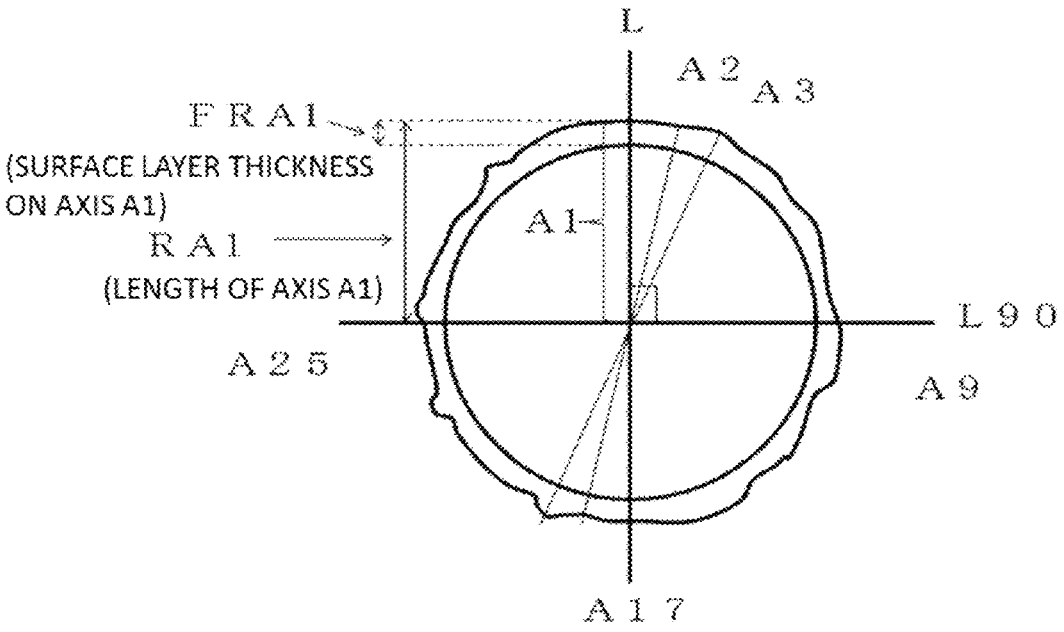
FIG. 1 is a drawing for explaining a cross-section of a toner particle obtained by TEM observation.

Although the following provides a detailed explanation of the present invention, the present invention is not limited thereto.

The toner of the present invention provides a toner comprising a toner particle that contains a binder resin, wherein the binder resin contains a vinylic resin and a polyester resin;

the vinylic resin contains an organic silicon polymer having a partial structure represented by the following formula (1) or the following formula (2):

[Chemical Formula 3]

formula (1)

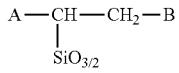

formula (2)

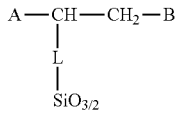

(wherein, A and B respectively and independently represent a partial structure represented by the following formula (3) or the following formula (4), and in formula (2), L represents a methylene group, ethylene group or phenylene group),

[Chemical Formula 4]

formula (3)

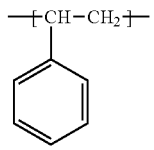

formula (4)

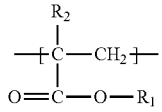

(wherein, $R_1$ represents a hydrogen atom or alkyl group having from 1 to 22 carbon atoms and $R_2$ represents a hydrogen atom or methyl group), the surface layer of the toner particle contains the organic silicon polymer, the proportion of a silicon atom in the organic silicon polymer having a structure represented by the $—SiO_{3/2}$ relative to a silicon atom in the organic silicon polymer contained in the toner particle is at least 5%, the polyester resin contains at least one polymer selected from the group consisting of polymers indicated in the following (i), (ii) and (iii):

(i) a polymer obtained by condensation polymerization of an alcohol component containing at least 50.0 mol % of an aliphatic diol having from 2 to 16 carbon atoms, and a carboxylic acid component containing at least 50.0 mol % of an aliphatic dicarboxylic acid having from 2 to 16 carbon atoms, (ii) a polymer obtained by condensation polymerization of an alcohol component containing at least 50.0 mol % of an aliphatic diol having from 2 to 16 carbon atoms, and a carboxylic acid component containing at least 50.0 mol % of an aromatic dicarboxylic acid having from 8 to 18 carbon atoms, and (iii) a polymer obtained by condensation polymerization of an alcohol component containing at least 50 mol % of an aromatic diol and a carboxylic acid component containing at least 50.0 mol % of an aliphatic dicarboxylic acid having from 2 to 16 carbon atoms, and the toner particle contains from at least 3.0% by mass to not more than 70.0% by mass of the polyester resin based on the binder resin contained in the toner particle.

According to the present invention, the organic silicon polymer represented by the above-mentioned formula (1) or the above-mentioned formula (2), which is a partial structure of the vinylic resin contained in the binder resin that composes the toner particle, is a hybrid resin having an organic structure and an inorganic structure. This organic-inorganic hybrid resin is formed by condensation polymerization of organic structure segments and inorganic structure segments respectively.

On the other hand, the polyester resin of the present invention has a specific alkyl segment within an alcohol component or dicarboxylic acid component. When various resins have been compatible with each other, the above-mentioned alkyl segment has a considerable effect on lowering the glass transition temperature (Tg) of the resin, and has a considerable effect on low-temperature fixability.

However, contrary to lowering resin Tg, exuding of low molecular weight resin components onto the surface of the toner particle ends up occurring easily. This phenomenon is particularly prominent in the case of polyester resins that use a monomer having a short alkyl chain length or low molecular weight polyester resins. This is thought to be due to increased migration to the surface of the toner particle caused by enhanced resin polarity as a result of an increase in the concentration of ester groups within the polyester resin having the composition described above and the concentrations of terminal alcohol components and carboxylic acid components.

In the present invention, superior storage stability was realized while achieving a lowering of the Tg of the resin that composes the toner particle by using the above-mentioned polyester. This is thought to be due to interaction between the alkyl segment of the above-mentioned polyester and the organic segment of the organic silicon polymer contained in the vinylic resin inhibiting exuding of low-molecular weight components and low Tg components.

In addition, it was found that, as a result of the organic silicon polymer represented by the above-mentioned formula (1) or the above-mentioned formula (2) being present in the surface layer of the toner particle, exuding of low-molecular weight resin components onto the surface of the toner particle can be dramatically inhibited, thereby improving long-term storage stability. This is thought to be caused by the partial structure of formula (3) in the above-mentioned formula (1) or the above-mentioned formula (2) used in the present invention further enhancing hydrophobicity due to its organic structure and the partial structure of formula (4) further enhancing interaction with the polyester resin.

A toner having superior environmental stability can be obtained as a result of the organic structure segment of formula (3) improving hydrophobicity.

On the other hand, the partial structure of formula (4) forms a carboxylic acid segment or alkyl ester segment on a side chain of the organic structure segment, and shielding of low-molecular weight resin components is presumed to be improved as a result of demonstrating interaction with the polyester resin independent of the inorganic structure segment.

In addition, storage stability improved in the case $R_1$ in formula (4) was an aliphatic alkyl ester having a large number of carbon atoms. This is thought to be due to even greater interaction with alkyl groups in the polyester resin.

However, since the polyester resin has difficulty softening if interaction is excessively strong, low-temperature fixability tends to worsen. Conversely, low-temperature fixability was superior in the case $R_1$ in formula (4) was a hydrogen atom or an alkyl group having a small number of carbon atoms. Accordingly, it was determined that $R_1$ in formula (4) is required to be a hydrogen atom or an alkyl group having from 1 to 22 carbon atoms. In addition, the case of the above-mentioned $R_1$ being an alkyl group having from 4 to 18 carbon atoms is preferable from the viewpoint of the balance between low-temperature fixability and storage stability.

On the other hand, storage stability was determined to not be adequate in the case the organic silicon polymer has a partial structure represented by the following formula (7) (wherein, A and B are defined in the same manner as formula (1)), namely in the case it has a partial structure in the manner of having an ester group in the main chain of the organic crosslinked moiety. This is thought to be due to it being difficult to form an inorganic crosslinked moiety due to the large number of atoms of the organic crosslinked moiety and the excessively long distance. Moreover, as a result of the ester group being exposed on the surface layer of the toner particle, interaction with the polyester resin occurs easily on the side of the uppermost surface layer, thereby resulting in increased susceptibility to the occurrence of exuding of low-molecular weight components and low Tg components.

[Chemical Formula 5]

formula (7)

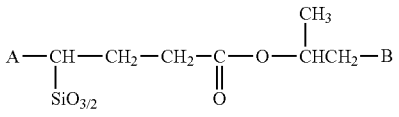

In the present invention, the toner particle has the above-mentioned organic silicon polymer in the surface layer of the toner particle. In addition, the proportion of the silicon atom in the organic silicon polymer having the structure represented by the above-mentioned —$SiO_{3/2}$ relative to the silicon atom in the organic silicon polymer contained in the toner particle is at least 5%. As a result of satisfying the above-mentioned numerical range, toner particle can be obtained that have superior storage stability and development durability due to inhibition of development durability attributable to the above-mentioned partial structure and inhibition of bleeding of low-molecular weight (weight-average molecular weight [Mw] of 1,000 or less) resin, resin having a low Tg (40° C. or lower) and release agent attributable to the organic group in the above-mentioned formula (1).

On the other hand, the above-mentioned effects were determined to not be adequately obtained in the case the above-mentioned numerical range is not satisfied. In other words, in the case the proportion of the silicon atom in the organic silicon polymer having a structure represented by the above-mentioned —$SiO_{3/2}$ relative to the silicon atom in the organic silicon polymer contained in the toner particle is less than 5%, the effects of inhibiting development durability and bleeding become inadequate due to inadequate inorganic crosslinking. The proportion of the silicon atom in the organic silicon polymer having a structure represented by the above-mentioned $SiO_{3/2}$ is preferably at least 10% and more preferably at least 15%. On the other hand, in the case of excessive inorganic crosslinking, since the organic silicon polymer becomes hard, the above-mentioned proportion is preferably not more than 70% from the viewpoints of an increase in the need to raise pressure during fixation.

Furthermore, the proportion of the silicon atom in the organic silicon polymer can be controlled according to the type of monomer used in the organic silicon polymer and the reaction temperature, reaction time, reaction solvent and pH when forming the organic silicon polymer.

A typical example of a method used to produce the organic silicon polymer used in the present invention is a method referred to as the sol-gel method.

The sol-gel method is a method that consists of carrying out hydrolysis and condensation polymerization in a solvent using a metal alkoxide M(OR)n (wherein, M represents a metal, O represents oxygen, R represents a hydrocarbon and n represents the oxidation number of the metal) for the starting material followed by gelling by going through a sol state to synthesize glass, ceramics, organic-inorganic hybrids and nanocomposites. The use of this production method enables various forms of functional materials such as surface layers, fibers, bulk forms or microparticles to be produced from the liquid phase at low temperatures.

More specifically, the surface layer of the toner particle is preferably formed by hydrolysis and condensation polymerization of a silicon compound represented by an alkoxysilane.

As a result of a surface layer having this organic silicon polymer being uniformly provided on the surface of the toner particle, environmental stability improves without having to carry out adhesion or adherence of inorganic fine particles as carried out in the toner of the related art, it is difficult for a decrease in toner particle performance to occur during long-term use, and a toner can be obtained that has superior storage stability.

Moreover, since the sol-gel method consists of forming a material by starting from a solution and then gelling that solution, various microstructures and shapes can be created. In the case of producing toner particle in an aqueous medium in particular, the organic silicon compound is easily made to be present on the surface of the toner particle due to hydrophilicity generated by hydrophilic groups in the manner of silanol groups of the organic silicon compound. Such microstructures and shapes can be adjusted according to, for example, the reaction temperature, reaction time, reaction solvent and pH during formation of the organic silicon polymer and the type and amount of organic silicon compound that composes the organic silicon polymer.

In the present invention, use of the above-mentioned polyester resin was found to be effective for demonstrating low-temperature fixability. The polyester resin used in the present invention contains a specific aliphatic alkyl segment in the form of a diol component or dicarboxylic acid component that composes the polyester resin at a specific ratio. As a result, the Tg of the binder resin overall is lowered as a result of improved compatibility with the binder resin. As a result, the temperature required to reach a resin viscosity that allows fixation is easily lowered.

A melting point appears easily when the polyester resin used in the present invention is:

(i) a polymer obtained by condensation polymerization of an alcohol component containing at least 50.0 mol % of an aliphatic diol having from 2 to 16 carbon atoms, and a carboxylic acid component containing at least 50.0 mol % of an aliphatic dicarboxylic acid having from 2 to 16 carbon atoms.

Since the above-mentioned polyester resin has a melting point, compatibility in the binder resin is inhibited until a temperature close to the melting point and the Tg of the binder resin does not decrease. On the other hand, when the polyester resin is heated to the vicinity of the melting point during fixation, the aforementioned polyester resin begins to demonstrate compatibility with nearby binder resin, thereby enabling the Tg of the resin to decrease suddenly. Consequently, both superior storage stability and low-temperature fixability can be realized.

Adequate lowering of the Tg of the aforementioned resin for low-temperature fixation is obtained due to a compatibility effect attributable to the aliphatic segment when the polyester resin used in the present invention is:

(ii) a polymer obtained by condensation polymerization of an alcohol component containing at least 50.0 mol % of an aliphatic diol having from 2 to 16 carbon atoms, and a carboxylic acid component containing at least 50.0 mol % of an aromatic dicarboxylic acid having from 8 to 18 carbon atoms, or (iii) a polymer obtained by condensation polymerization of an alcohol component containing at least 50 mol % of an aromatic diol and a carboxylic acid component containing at least 50.0 mol % of an aliphatic dicarboxylic acid having from 2 to 16 carbon atoms.

In the case of using an aliphatic diol having more than 16 carbon atoms or an aliphatic dicarboxylic acid having more than 16 carbon atoms, development durability in low-humidity environments was determined to worsen. This is thought to be due to inadequate compatibility between the long-chain alkyl component and vinylic resin, thereby resulting in a loss of elasticity of the binder resin causing it to become brittle. In addition, low-temperature fixability is also not favorable.

In addition, in the case the diol component and the dicarboxylic acid component both consist mainly of aromatic components, development durability after standing in a high-humidity environment was determined to be impaired. This is thought to be due to the fact that, despite compatibility increasing between the vinylic resin and the polyester resin, exuding of resin onto the surface layer of the toner particle is induced at high humidity. Consequently, storage stability is not favorable.

In the present invention, the above-mentioned polyester resin preferably has a melting point. when the polyester resin has a melting point, compatibility with the binder resin is inhibited to the vicinity of the melting point, thereby resulting in a dramatic improvement in storage stability at or below the melting point.

The melting point of the polyester resin is preferably from at least 40.0° C. to not more than 90.0° C. when the melting point of the polyester resin is 40.0° C. or higher, the degree of crystallinity of the polyester resin is high and adequate storage stability can be realized. In addition, when the melting point is 90.0° C. or lower, since the polyester resin is able to adequately soften even if the temperature required for fixation is low, low-temperature fixability can be further improved. The melting point of the polyester resin is more preferably from at least 50.0° C. to not more than 75.0° C.

In the present invention, the weight-average molecular weight of the above-mentioned polyester resin is preferably from at least 4,000 to less than 100,000. when the weight-average molecular weight is 4,000 or more, storage stability is superior since the degree of crystallinity can be made to be high. In addition, when the weight-average molecular weight is less than 100,000, low-temperature fixability is superior since compatibility with the binder resin is adequate. The weight-average molecular weight is more preferably from at least 10,000 to less than 50,000.

The toner particle used in the present invention contains from at least 3.0% by mass to not more than 70.0% by mass, preferably from at least 3.0% by mass to not more than 50.0% by mass, and more preferably from at least 5.0% by mass to not more than 30.0% by mass of the aforementioned polyester resin based on the aforementioned binder resin contained in the toner particle.

Both heat-resistant storability and low-temperature fixability can be realized by containing a specified amount of a specific polyester in the toner particle.

In the present invention, a preferable aspect thereof is that in which the above-mentioned polyester resin is a styrene-denatured polyester resin that has been denatured with styrene. Elasticity of the binder resin can be obtained while enhancing compatibility and maintaining the melting point by denaturing the above-mentioned polyester resin with styrene. As a result, more superior storage stability and low-temperature fixability can be realized.

In the case of denaturing the above-mentioned polyester resin with styrene, the denaturation ratio (based on mass) is preferably less than 50%. When the denaturation ratio is less than 50%, the degree of crystallinity of the above-mentioned polyester resin can be maintained.

In the present invention, the content of the styrene-denatured polyester resin is such that the content of the polyester segment in the above-mentioned styrene-denatured polyester resin satisfies the range of the content of the above-mentioned polyester resin.

In the present invention, the partial structure represented by the above-mentioned formula (1) or the partial structure represented by the above-mentioned formula (2) demonstrates strong bonding energy between the organic structure and the silicon atom, and development durability improves because organic and inorganic bonds are strong.

In the present invention, the ratio (dSi/[dC+dH+dSi+dS]) of the density of a silicon atom dSi to the total density (dC+dH+dSi+dS) of the density of a carbon atom dC, the density of a hydrogen atom dH, the density of a silicon atom dSi and the density of a sulfur atom dS in the surface of the toner particle as determined by measuring the surface of the toner particle using X-ray photoelectron spectroscopic analysis (electron spectroscopy for chemical analysis (ESCA)) is preferably at least 0.5 atom %, more preferably at least 1.0 atom %, even more preferably at least 2.5 atom %, particularly preferably at least 5.0 atom % and still more preferably at least 10.0 atom %.

The above-mentioned ESCA consists of carrying out an elementary analysis of the surface present at a thickness of several nm towards the center (midpoint of the long axis) of the toner particle from the surface of the toner particle. As a result of the ratio (dSi/[dC+dH+dSi+dS]) of the density of silicon atom in the surface of toner particle being at least 0.5 atom %, the surface free energy of the surface can be reduced. By adjusting the above-mentioned silicon atom density to be 0.5 atom % or more, flowability can be further improved and the occurrence of contamination of members and fogging can be more effectively inhibited. On the other hand, the density of the silicon atom of the surface of the above-mentioned toner particle is preferably not more than 33.3 atom % from the viewpoint of charging performance.

Furthermore, the above-mentioned surface refers to the region extending from 0.0 nm to 10.0 nm from the surface of the toner particle towards the center (midpoint of the long axis) of the toner particle.

The density of the silicon atom of the surface of the toner particle can be controlled according to the organic group present in the above-mentioned formula (1) or the above-mentioned formula (2) and according to the reaction temperature, reaction time, reaction solvent and pH during formation of the organic silicon polymer. In addition, the density of the silicon atom can also be controlled according to the content of the organic silicon polymer.

In the present invention, when observing a cross-section of a toner particle using a transmission electron microscope (TEM), when the toner particle cross-section is equally divided into 16 sections centering on the intersection of the long axis L of the toner particle cross-section and an axis L90 that passes through the center of the long axis L and is perpendicular thereto, and dividing axes from the above-mentioned center to the surface of the toner particle are respectively designated as An (n=1 to 32), the average thickness Dav. of the surface layer of a toner particle that has the organic silicon polymer at 32 locations on the above-mentioned dividing axes (to also be referred to as "average thickness Dav. of the surface layer having the organic silicon polymer") is preferably at least 5.0 nm. As a result, the occurrence of bleeding attributable to release agent and resin components present inside from the surface layer having the organic silicon polymer of the toner particle is inhibited, and a toner can be obtained that has superior storage stability, environmental stability and development durability. The average thickness Dav. of the surface layer having the organic silicon polymer of the toner particle is preferably at least 7.5 nm and more preferably at least 10.0 nm from the viewpoint of storage stability.

When the above-mentioned average thickness Dav. of the surface layer having the organic silicon polymer surface layer of the toner particle is less than 5.0 nm, bleeding attributable to resin components and release agent present in the toner particle occurs easily. Consequently, the surface properties of the toner particle change and environmental stability and development durability tend to worsen. On the other hand, in the case the average thickness Dav. of the surface layer having the organic silicon polymer of the toner particle exceeds 150.0 nm, low-temperature fixability tends to worsen. Consequently, in order to obtain superior low-temperature fixability, the above-mentioned average thickness Dav. of the surface layer having the organic silicon polymer of the toner particle is preferably not more than 150.0 nm, more preferably not more than 100.0 nm and even more preferably not more than 50.0 nm.

In the present invention, when observing a cross-section of a toner particle using a transmission electron microscope (TEM), when the toner particle cross-section is equally divided into 16 sections centering on the intersection of the long axis L of the toner particle cross-section and an axis L90 that passes through the center of the long axis L and is perpendicular thereto, and dividing axes from the above-mentioned center towards the surface of the toner particle are respectively designated as An (n=1 to 32), the proportion of the portion (number of dividing axes) where the thickness of the surface layer of toner particle that has the organic silicon polymer for each of the 32 dividing axes present is not more than 5.0 nm (to also be referred to as the "proportion of the surface layer having the organic silicon polymer having a thickness of not more than 5.0 nm") is preferably not more than 20.0%, more preferably not more than 13.0% and even more preferably not more than 5.0% (see FIG. 1).

By making the proportion of the surface layer having the organic silicon polymer having a thickness of not more than 5.0 nm to be 20.0% or less, fogging can be reduced in various environments and toner particle can be obtained that have superior development durability.

The above-mentioned average thickness Dav. of the surface layer having the organic silicon polymer of the above-mentioned toner particle and the above-mentioned proportion of the surface layer having the organic silicon polymer having a thickness of not more than 5.0 nm can be adjusted according to the reaction temperature, reaction time, reaction solvent and pH of hydrolysis, addition polymerization and condensation polymerization during formation of the organic silicon polymer. In addition, they can also be controlled according to the content of the organic silicon polymer.

The organic silicon polymer used in the present invention is preferably an organic silicon polymer obtained by polymerizing an organic silicon compound having a structure represented by the following formula (5) or formula (6).

[Chemical Formula 6]

formula (5)

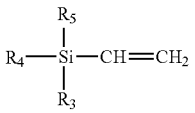

formula (6)

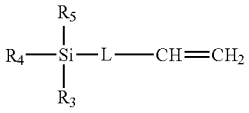

(wherein, $R_3$, $R_4$ and $R_5$ respectively and independently represent a halogen atom, hydroxyl group or alkoxy group, and in formula (6), L represents a methylene group, ethylene group or phenylene group).

The alkoxy group of $R_3$, $R_4$ and $R_5$ in formula (6) is preferably a methoxy group or an ethoxy group.

The density of the silicon atom of the surface of the toner particle in the above-mentioned ESCA measurement, the average thickness Dav. of the surface layer having the organic silicon polymer of the organic toner particle and the proportion of the surface layer having the organic silicon polymer having a thickness of not more than 5.0 nm can be easily controlled by controlling the reaction temperature, reaction time, reaction solvent and pH when forming the organic silicon polymer using an organic silicon compound having a structure represented by formula (5) or formula (6).

In the present invention, the added amount of the organic silicon compound having a structure represented by formula (5) or formula (6) is preferably from at least 0.3 parts by mass to not more than 25 parts by mass based on 100 parts by mass of the binder resin.

In the present invention, an organic silicon polymer may also be used that is obtained by using the organic silicon compound having a structure represented by formula (5) or formula (6) in combination with an organic silicon compound having four reaction groups in a molecule thereof (tetrafunctional silane), an organic silicon compound having three reaction groups in a molecule thereof (trifunctional silane), an organic silicon compound having two functional groups in a molecule thereof (bifunctional silane), or an organic silicon compound having a single reaction group (monofunctional silane). Examples of organic silicon compounds that may be used in combination include:

trifunctional methylsilanes in the manner of methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane or methyldiethoxyhydroxysilane, trifunctional silanes in the manner of ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane or hexyltrihydroxysilane, and trifunctional phenylsilanes in the manner of phenyltrimethoxysilane, phenyltriethoxysilane, phenyltrichlorosilane, phenyltriacetoxysilane or phenyltrihydroxysilane.

dimethyldiethoxysilane, tetraethoxysilane, hexamethyldisilazane, 3-glycidoxypropyltrimethoxysilane, 3-glycidoxypropylmethyldiethoxysilane, 3-glycidoxypropyltriethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, 3-(2-aminoethyl) aminopropyltrimethoxysilane, 3-(2-aminoethyl) aminopropyltriethoxysilane, 3-phenylaminopropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, 3-glycidoxypropyltriethoxysilane, 3-glycidoxypropylmethyldimethoxysilane, 3-glycidoxypropylmethyldiethoxysilane, hexamethyldisiloxane, tetraisocyanate silane, methyltriisocyanate silane or vinyltriisocyanate silane.

In general, the bonding state of siloxane bonds formed according to the degree of acidity of the reaction medium is known to change in sol-gel reactions. More specifically, in the case the reaction medium is acidic, hydrogen ions are electrophilically added to oxygen of a single reaction group (such as an alkoxy group (—OR group)). Next, oxygen atoms in water molecules coordinate to silicon atoms and become hydrosilyl groups by a substitution reaction. In the case adequate water is present, since a single oxygen of a reaction group (such as an alkoxy group (—OR group)) is attacked by a single H+, when the content of H+ in the reaction medium is low, the substitution reaction to a hydroxyl group becomes slow. Accordingly, all reaction groups bound to silicon atom undergo a condensation polymerization reaction prior to hydrolysis, thereby resulting in one-dimensional linear polymers and two-dimensional polymers being formed comparatively easily.

On the other hand, in the case the reaction medium is alkaline, hydroxide ions go through a pentacoordinated intermediate by being added to silicon. Consequently, all reaction groups (such as alkoxy groups (—OR group)) are easily eliminated and easily substituted with silanol groups. In the case of using a silicon compound having three or more reaction groups in the same silicon atom in particular, hydrolysis and condensation polymerization occur three-dimensionally and an organic silicon polymer is formed that has numerous three-dimensional crosslinking bonds. In addition, the reaction is completed in a short period of time.

Thus, in order to form the organic silicon polymer, it is preferable to carry out a sol-gel reaction with the reaction medium in an alkaline state, and specifically in the case of producing in an aqueous medium, the pH is preferably 8.0 or higher. As a result, an organic silicon polymer can be formed that demonstrates higher strength and superior durability. In addition, the sol-gel reaction is preferably carried out at a reaction temperature of 90° C. or higher and the reaction time is preferably 5 hours or longer.

As a result of carrying out this sol-gel reaction at the above-mentioned reaction temperature and reaction time, the formation of coalesced particles, formed by the mutual bonding of silane compounds in the state of a sol or gel on the surface of the toner particle, can be inhibited.

In addition, a metal coupling agent may be used in combination to a degree that does not impair the effects of the present invention from the viewpoint of controlling charging of the surface layer of the toner particle that has the organic silicon polymer. Although examples of metal species include titanium, aluminum and zirconium, the use of a titanium-based coupling agent or aluminum-based coupling agent as a metal coupling agent is preferable.

The following lists examples of titanium-based coupling agents:

The following lists examples of organic titanium compounds: titanium methoxide, titanium ethoxide, titanium n-propoxide, tetra-1-propoxytitanium, tetra-n-butoxytitanium, titanium isobutoxide, titanium butoxide dimer, titanium tetra-2-ethylhexoxide, titanium diisopropoxybis (acetylacetonate), titanium tetraacetylacetonate, titanium di-2-ethylhexoxybis(2-ethyl-3-hydroxyhexoxide), titanium diisopropoxybis(ethylacetoacetate), tetrakis(2-ethylhexyloxy) titanium, di-1-propoxybis(acetylacetonate) titanium, titanium lactate, titanium methacrylate isopropoxide, triisopropoxy titanate, titanium methoxypropoxide and titanium stearyl oxide.

The following lists examples of aluminum-based coupling agents:

aluminum (III)-n-butoxide, aluminum (III) s-butoxide, aluminum (III) s-butoxide bis(ethylacetoacetate), aluminum (III) t-butoxide, aluminum (III) di-s-butoxide ethylacetoacetate, aluminum (III) diisopropoxide ethylacetoacetate, aluminum (III) ethoxide, aluminum (III) ethoxyethoxyethoxide, aluminum hexafluoropentanedionate, aluminum (III) 3-hydroxy-2-methyl-4-pyronate, aluminum (III) isopropoxide, aluminum 9-octadecenylacetoacetate diisopropoxide, aluminum (III) 2,4-pentanedionate, aluminum phenoxide and aluminum (III) 2,2,6,6-tetramethyl-3,5-heptanedionate.

Furthermore, these coupling agents may be used alone or a plurality of types may be used in combination. Charge quantity can be adjusted by suitably combining these compounds or changing the added amounts thereof.

The following provides an explanation of a method for producing toner particle in the present invention.

Although the following provides an explanation of a specific mode in which the organic silicon polymer is contained in the surface of the toner particle, the present invention is not limited thereto.

An example of a first production method consists of a mode in which toner particles are obtained by forming particles of a polymerizable monomer composition containing an organic silicon compound for forming, in an aqueous medium, an organic silicon polymer, a polymerizable monomer for forming a binder resin, and the above-mentioned polyester resin followed by polymerizing the above-mentioned organic silicon compound and the above-mentioned polymerizable monomer (to also be referred to as "suspension polymerization"). The production of toner particles by the above-mentioned suspension polymerization enables the organic silicon polymer to be distributed in a preferable state and amount in the surface layer of the toner particle.

An example of a second production method consists of a mode in which, after preliminarily obtaining a parent body of toner particles, the parent body of the toner particles is placed in an aqueous medium and a surface layer having an organic silicon polymer is formed on the parent body of the toner particles in an aqueous medium. The parent body of the toner particles may be obtained by melting and kneading a binder resin and the above-mentioned polyester resin followed by pulverizing. In addition, the parent body may also be obtained by aggregating binder resin particles and the above-mentioned polyester resin particles in an aqueous medium and allowing them to associate. Moreover, the parent body may also be obtained by dissolving a binder resin, an organic silicon compound for obtaining an organic silicon polymer and the above-mentioned polyester resin in an organic solvent, suspending the resulting organic phase dispersion in an aqueous medium to form (granulate) particles and polymerizing followed by removing the organic solvent.

An example of a third production method consists of a mode in which toner particles are obtained by dissolving a binder resin, an organic silicon compound for obtaining an organic silicon polymer and the above-mentioned polyester resin in an organic solvent, suspending the resulting organic phase dispersion in an aqueous medium, forming (granulating) particles and polymerizing followed by removing the organic solvent.

An example of a fourth production method consists of a mode in which toner particles are formed by aggregating binder resin particles, particles of the above-mentioned polyester resin, and particles containing an organic silicon compound for forming an organic silicon polymer in the form of a sol or gel in an aqueous medium and allowing to associate therein.

An example of a fifth production method consists of a mode in which a surface layer having an organic silicon polymer is formed on toner particles by spraying a solvent containing an organic silicon compound for forming an organic silicon polymer (which may also be polymerized to a certain degree) onto the surface of a parent body of the toner particles by a spray drying method, and polymerizing or drying the surface with hot air current or by cooling. The parent body of the toner particles may be obtained by melting and kneading a binder resin and the above-mentioned polyester resin followed by pulverizing, by aggregating binder resin particles and particles of the above-mentioned polyester resin in an aqueous medium and allowing them to associate, or by dissolving a binder resin, an organic silicon compound for forming an organic silicon polymer and the above-mentioned polyester resin in an organic solvent, suspending the resulting organic phase dispersion in an aqueous medium to form (granulate) particles, and polymerizing followed by removing the organic solvent.

Toner particles produced according to these production methods have favorable environmental stability (and favorable charging performance in harsh environments in particular) since an organic silicon polymer is formed in a precipitated state near the surface of the toner particles or on the surface of the toner particles. In addition, changes in the surface status of toner particles caused by bleeding of release agent or resin within the toner are inhibited even in harsh environments.

In the present invention, the toner particle or toner may be subjected to surface treatment using hot air current. As a result of carrying out surface treatment of the toner particle or toner using hot air current, condensation polymerization of the organic silicon polymer near the surface of the toner particle can be accelerated and environmental stability and development durability can be improved.

Any means may be used for the above-mentioned surface treatment using hot air current provided the surface of the toner particle or toner can be treated with hot air current and the toner particle or toner treated with hot air current can be cooled with cold air.

Examples of apparatuses used to carry out surface treatment using hot air current include a hybridization system (Nara Machinery Co., Ltd.), Mechano-Fusion system (Hosokawa Micron Ltd.), Faculty (Hosokawa Micron Ltd.) and Meteo Rainbow MR type (Nippon Pneumatic Mfg. Co., Ltd.).

Examples of the aqueous medium in the above-mentioned production methods are listed below:

water, alcohols in the manner of methanol, ethanol or propanol, and mixed solvents thereof.

Among the previously described production methods, the suspension polymerization method of the first production method is preferable for the production method of the toner particles of the present invention. In the suspension polymerization method, the organic silicon polymer easily precipitates uniformly on the surface of the toner particles, adhesion between the interior and the surface layer having the organic silicon polymer of the toner particle is superior, and storage stability, environmental stability and development durability are favorable. The following provides a further explanation of the suspension polymerization method.

A colorant, release agent, polar resin and low-molecular weight resin may be added as necessary to the previously described polymerizable monomer composition. In addition, following completion of the polymerization step, particles formed are washed and recovered by filtration and drying to obtain toner particles. Furthermore, the temperature may be raised during the latter half of the above-mentioned polymerization step. Moreover, in order to remove unreacted polymerizable monomer or by-products, a portion of the dispersion medium can be distilled off from the reaction system during the latter half of the polymerization step or following completion of the polymerization step.

Preferable examples of the polymerizable monomer in the above-mentioned suspension polymerization method include the following vinylic polymerizable monomers: styrene, styrene derivatives in the manner of α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene or p-phenylstyrene, acrylic polymerizable monomers in the manner of methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate or 2-benzoyloxy ethyl acrylate, methacrylic polymerizable monomers in the manner of methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate or dibutylphosphate ethyl methacrylate, methylene aliphatic monocarboxylic acid esters, vinyl esters in the manner of vinyl acetate, vinyl propionate, vinyl benzoate, vinyl butyrate or vinyl formate, vinyl ethers in the manner of vinyl methyl ether, vinyl ethyl ether or vinyl isobutyl ether, and vinyl ketones in the manner of vinyl methyl ketone, vinyl hexyl ketone or vinyl isopropyl ketone.

Among these vinylic polymerizable monomers, vinylic polymerizable monomers for forming styrene polymers, styrene-acrylic copolymers or styrene-methacrylic copolymers are preferable from the viewpoint of efficiently covering the release agent mainly formed inside or in the central portion. The use of the above-mentioned vinylic polymerizable monomer results in favorable adhesion with vinylic resin containing an organic silicon polymer, and storage stability and development durability are favorable.

A polymerization initiator may be added during polymerization of the above-mentioned polymerizable monomer. Examples of polymerization initiators are as follows:

azo-based or diazo-based polymerization initiators in the manner of 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile or azobisisobutyronitrile, and peroxide-based polymerization initiators in the manner of benzoyl peroxide, methyl ethyl ketone peroxide, diisopropylperoxycarbonate, cumene hydroperoxide, 2,4-dichlorobenzoyl peroxide or lauroyl peroxide. These polymerization initiators are preferably added to the polymerizable monomer at 0.5% by mass to 30.0% by mass and may be used alone or in combination.

In addition, a chain transfer agent may be added during polymerization of the polymerizable monomer in order to control the molecular weight of the binder resin that composes the toner particles. The added amount of chain transfer agent is preferably 0.001% by mass to 15.000% by mass of the polymerizable monomer.

On the other hand, a crosslinking agent may be added during polymerization of the polymerizable monomer in order to control the molecular weight of the binder resin that composes the toner particles. The following lists examples of crosslinking agents:

divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, respective diacrylates of polyethylene glycol #200, #400 and #600, dipropylene glycol diacrylate, polypropylene glycol diacrylate, polyester-based diacrylate (trade name: Manda, Nippon Kayaku Co., Ltd.) and those in which acrylate has been changed to methacrylate.

In addition, the following lists examples of polyfunctional crosslinking agents:

pentaerythritol triacrylate, trimethylolethane triacrylate, trimethylolpropane triacrylate, tetramethylolmethane tetraacrylate, oligoester acrylates and methacrylates thereof, 2,2-bis(4-methacryloxy-polyethoxyphenyl)propane, diacryl phthalate, triallyl cyanurate, triallyl isocyanurate, triallyl trimellitate and diallyl chlorendate. The added amount of crosslinking agent is preferably 0.001% by mass to 15.000% by mass with respect to the polymerizable monomer.

The binder resin that composes the toner particle contains a vinylic resin. The above-mentioned vinylic resin is formed by polymerizing the previously described vinylic polymerizable monomer. Vinylic resins have superior environmental stability. In addition, the above-mentioned vinylic resin demonstrates superior precipitability and surface uniformity on the surface of the toner particle of the organic silicon polymer having a partial structure represented by the above-mentioned formula (1) or formula (2), thereby making this preferable.

In the present invention, the vinylic resin is a (co)polymer that contains at least one of a monomer that forms a partial structure represented by the above-mentioned formula (3) and a monomer that forms a partial structure represented by formula (4) as constituents of the (co)polymer. The ratio (based on mass) between the monomer that forms a partial structure represented by the above-mentioned formula (3) and the monomer that forms a partial structure represented by formula (4) is preferably from 95:5 to 5:95 and more preferably from 90:10 to 50:50.

In the case the medium used when polymerizing the above-mentioned polymerizable monomer is an aqueous medium, the materials indicated below can be used as dispersion stabilizers in an aqueous medium of particles of the polymerizable monomer composition.

Examples of inorganic dispersion stabilizers include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

In addition, examples of organic dispersion stabilizers include polyvinyl alcohol, gelatin, methyl cellulose, methyl hydroxypropyl cellulose, ethyl cellulose, carboxymethyl cellulose sodium salt and starch.

Moreover, commercially available nonionic, anionic and cationic surfactants can also be used. The following lists examples of such surfactants:

sodium dodecyl sulfate, sodium tetradecyl sulfate, sodium pentadecyl sulfate, sodium octyl sulfate, sodium oleate, sodium laurate and potassium stearate.

In the present invention, in the case of preparing an aqueous medium using a poorly soluble inorganic dispersion stabilizer, the added amount of these dispersion stabilizers is preferably from 0.2 parts by mass to 2.0 parts by mass based on 100 parts by mass of the polymerizable monomer composition. In addition, an aqueous medium is preferably prepared using from 300 parts by mass to 3,000 parts by mass of water based on 100 parts by mass of the of the polymerizable monomer composition.

In the present invention, in the case of preparing an aqueous medium in which a poorly soluble inorganic dispersion stabilizer has been dispersed as described above, a commercially available dispersion stabilizer may be used as it is. In addition, a poorly soluble inorganic dispersing agent may be formed while stirring at high speed in a liquid medium such as water in order to obtain a dispersion stabilizer having a fine, uniform particle size. More specifically, in the case of using tricalcium phosphate for the dispersion stabilizer, a preferable dispersion stabilizer can be obtained by mixing an aqueous sodium phosphate solution and an aqueous calcium chloride solution while stirring at high speed to form fine particles of tricalcium phosphate.

In the present invention, the binder resin contains the above-mentioned vinylic resin containing the organic silicon polymer and the above-mentioned polyester resin.

In the present invention, the binder resin may also be used in combination with a resin other than the above-mentioned vinylic resin containing the organic silicon polymer and the above-mentioned polyester resin within a range that does not affect the effects of the present invention.

An aromatic polyester resin produced using a polyvalent aromatic alcohol component and a polyvalent aromatic carboxylic acid component is preferable for the polyester resin other than the above-mentioned polyester resin from the viewpoint of improving charged state stability.

The polyester resin can be produced by a known production method from a polyvalent aromatic alcohol and a polyvalent aromatic carboxylic acid. Among those monomers that compose aromatic polyester resins, examples of polyvalent aromatic alcohols include hydrogenated bisphenol A, bisphenol derivatives represented by the following formula (A) and diols represented by the following formula (B). These polyvalent alcohols may be used alone or may be used as a mixture. However, the polyvalent alcohols are not limited thereto, but rather other alcohols having valence of three or more can also be used as crosslinking components.

[Chemical Formula 7]

formula (A)

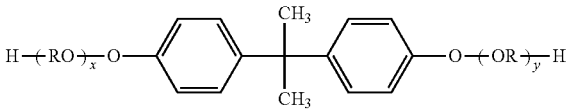

(A)

(In formula (A), R represents an ethylene group or propylene group, x and y respectively and independently represent an integer of 1 or more, and the average value of x+y is from 2 to 10.)

[Chemical Formula 8]

formula (B)

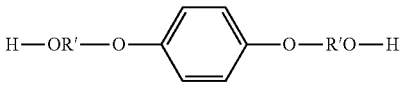

(B)

(In formula (B), R' represents any of the groups indicated below and R' may be the same or different.)

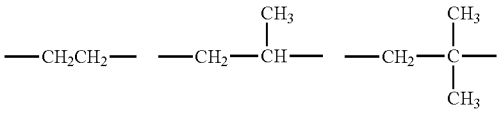

Among those monomers that compose the aromatic polyester resin, examples of aromatic polyvalent carboxylic acids include dicarboxylic acids in the manner of naphthalenedicarboxylic acid, phthalic acid, isophthalic acid or terephthalic acid, dicarboxylic acid anhydrides in the manner of phthalic anhydride and lower alkyl esters of dicarboxylic acids in the manner of dimethyl terephthalate.

The above-mentioned aromatic polyester resin may be crosslinked by using the following carboxylic acids having a valence of 3 or more: trimellitic acid, tri-n-ethyl 1,2,4-benzenetricarboxylic acid, tri-n-butyl 1,2,4-benzenetricarboxylic acid, tri-n-hexyl 1,2,4-benzenetricarboxylic acid, triisobutyl 1,2,4-benzenetricarboxylic acid, tri-n-octyl 1,2,4-benzenetricarboxylic acid, tri-2-ethylhexyl 1,2,4-benzenetricarboxylic acid and lower alkyl esters of tricarboxylic acids. However, carboxylic acid having a valence of 3 or more is not limited thereto, but rather other carboxylic acids having a valence of 3 or more or lower alkyl esters of carboxylic acids having a valence of 3 or more can also be used as crosslinking components.

In addition, the above-mentioned aromatic polyester resin may also use a monovalent carboxylic acid or monovalent alcohol. More specifically, examples thereof include monovalent carboxylic acids in the manner of benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid or stearic acid, and monovalent alcohols in the manner of n-butanol, isobutanol, sec-butanol, n-hexanol, n-octanol, lauryl alcohol, 2-ethylhexanol, decanol, cyclohexanol, benzyl alcohol or dodecyl alcohol.

The above-mentioned aromatic polyester resin can be obtained in the same manner as the above-mentioned polyester resin.

In the present invention, from the viewpoint of improving development durability, examples of vinylic resins other than the vinylic resin containing the organic silicon polymer include polymers of styrene monomer, acrylic acid monomer, methacrylic acid monomer, acrylic acid ester monomer, methacrylic acid ester monomer, 2-hydroxylethyl acrylic acid monomer, 2-hydroxyethyl methacrylic acid monomer, nitrogen-containing monomers in the manner of dimethylaminoethyl methacrylate and diethylaminoethyl methacrylate, and copolymers thereof; copolymers of the above-mentioned nitrogen-containing monomers and styrene-unsaturated carboxylic acid esters; nitrile-based monomers in the manner of acrylonitrile, halogen-containing monomers in the manner of vinyl chloride, unsaturated dibasic acids, unsaturated dibasic acid anhydrides and polymers of nitro-based monomers or copolymers of these and styrene-based monomers.

Preferable examples include styrene-based copolymers, acrylate-based copolymers and maleic acid copolymers containing at least an acrylic acid component or methacrylic acid component as a copolymer component. More preferable examples include styrene-based copolymers having an acid value and hydroxyl value. These copolymers make it possible to enhance binder resin elasticity and improve development durability.

In addition, the binder resin may include a hybrid resin of an aromatic polyester and vinylic polymer (to also be referred to as a "vinyl-denatured aromatic polyester resin"), as obtained by denaturing the above-mentioned aromatic polyester resin with a vinylic monomer within a range that does not affect the effects of the present invention.

This vinyl-denatured aromatic polyester resin has a structure in which the above-mentioned aromatic polyester resin and vinylic copolymer are bonded, internal protective performance is imparted by the polyester backbone, and charged state stability can be improved by the vinylic polymer.

The above-mentioned vinyl-denatured aromatic polyester resin is preferably that in which an aromatic polyester resin is chemically bonded to a vinylic polymer obtained by addition polymerization of an aromatic vinyl monomer and an acrylic acid ester-based monomer, or that in which an aromatic polyester resin is chemically bonded to a vinylic polymer obtained by addition polymerization of an aromatic vinyl monomer and a methacrylic acid ester-based monomer. In addition, the above-mentioned vinyl-denatured aromatic polyester resin can be formed by a transesterification reaction between a hydroxyl group contained in the polyester and the acrylic acid ester or methacrylic acid ester contained in the vinylic polymer, or by an esterification reaction between a hydroxyl group contained in the polyester and a carboxyl group contained in the vinylic polymer.

In the present invention, a release agent is preferably contained as one of the materials that compose the toner particle. Examples of the above-mentioned release agent include petroleum-based waxes and derivatives thereof in the manner of paraffin wax, microcrystalline wax or petrolatum, montan wax and derivatives thereof, hydrocarbon waxes obtained by the Fischer-Tropsch process and derivatives thereof, polyolefin waxes and derivatives thereof in the manner of polyethylene or polypropylene, natural waxes and derivatives thereof in the manner of carnauba wax or candelilla wax, higher aliphatic alcohols, fatty acids and compounds thereof in the manner of stearic acid or palmitic acid, acid amide waxes, ester waxes, ketones, hydrogenated castor oil and derivatives thereof, vegetable waxes, animal waxes and silicone resin.

Furthermore, derivatives include oxides, block copolymers and graft modification products with vinylic monomers.

The molecular weight of the release agent is such that the weight-average molecular weight (Mw) is preferably from 300 to 1,500 and more preferably from 400 to 1,250. As a result of adjusting the weight-average molecular weight to be within the above-mentioned ranges, low-temperature fixability can be further improved. Furthermore, the content of the release agent is preferably from 2% by mass to 30% by mass in the toner particle.

In the present invention, the toner particle may also contain a colorant as necessary. There are no particular limitations on the above-mentioned colorant and any of the known colorants indicated below can be used.

Condensed azo compounds such as yellow iron oxide, Naples yellow, naphthol yellow S, hansa yellow G, hansa yellow 10G, benzidine yellow G, benzidine yellow GR, quinoline yellow lake, permanent yellow NCG or tartrazine lake, isoindolinone compounds, anthraquinone compounds, azo metal complexes, methine compounds and allylamide compounds are used as yellow pigment. Specific examples thereof include the following:

C.I. pigment yellow 12, C.I. pigment yellow 13, C.I. pigment yellow 14, C.I. pigment yellow 15, C.I. pigment yellow 17, C.I. pigment yellow 62, C.I. pigment yellow 74, C.I. pigment yellow 83, C.I. pigment yellow 93, C.I. pigment yellow 94, C.I. pigment yellow 95, C.I. pigment yellow 109, C.I. pigment yellow 110, C.I. pigment yellow 111, C.I. pigment yellow 128, C.I. pigment yellow 129, C.I. pigment yellow 147, C.I. pigment yellow 155, C.I. pigment yellow 168 and C.I. pigment yellow 180.

The following lists examples of orange pigment:

permanent orange GTR, pyrazolone orange, Vulcan orange, benzidine orange G, indanthrene brilliant orange RK and indanthrene brilliant orange GK.

Examples of red pigment include condensed azo compounds such as bengala, permanent red 4R, lithol red, pyrazolone red, watching red calcium salt, lake red C, lake red D, brilliant carmine 6B, brilliant carmine 3B, eosin lake, rhodamine lake B or alizalin lake, diketopyrrolopyrole compounds, anthraquinone, quinacridone compounds, basic dye lake compounds, naphthol compounds, benzimidazolone compounds, thioindigo compounds and perylene compounds. Specific examples thereof include the following:

C.I. pigment red 2, C.I. pigment red 3, C.I. pigment red 5, C.I. pigment red 6, C.I. pigment red 7, C.I. pigment red 23, C.I. pigment red 48:2, C.I. pigment red 48:3, C.I. pigment red 48:4, C.I. pigment red 57:1, C.I. pigment red 81:1, C.I. pigment red 122, C.I. pigment red 144, C.I. pigment red 146, C.I. pigment red 166, C.I. pigment red 169, C.I. pigment red 177, C.I. pigment red 184, C.I. pigment red 185, C.I. pigment red 202, C.I. pigment red 206, C.I. pigment red 220, C.I. pigment red 221 and C.I. pigment red 254.

Examples of blue pigments include copper phthalocyanine compounds and derivatives thereof such as alkali blue lake, Victoria blue lake, phthalocyanine blue, metal-free phthalocyanine blue, phthalocyanine blue partial chloride, fast sky blue or indanthrene blue BG, anthraquinone compounds and basic dye lake compounds. Specific examples thereof include the following:

C.I. pigment blue 1, C.I. pigment blue 7, C.I. pigment blue 15, C.I. pigment blue 15:1, C.I. pigment blue 15:2, C.I. pigment blue 15:3, C.I. pigment blue 15:4, C.I. pigment blue 60, C.I. pigment blue 62 and C.I. pigment blue 66.

Examples of violet pigments include fast violet B and methyl violet lake.

Examples of green pigments include pigment green B, malachite green lake and final yellow green G. Examples of white pigments include zinc oxide, titanium oxide, antimony white and zinc sulfide.

Examples of black pigments include carbon black, aniline black, nonmagnetic ferrite, magnetite, and black pigments adjusted to black color using the above-mentioned yellow colorants, red colorants and blue colorants. These colorants can be used alone or as a mixture and can further be used in the state of a solid solution.

In addition, it is necessary to pay attention to the polymerization inhibitory properties and dispersion medium migration properties of colorants depending on the method used to produce the toner. Surface modification may be carried out as necessary by subjecting the colorant to surface treatment with a substance that does not inhibit polymerization. Particular caution is required when using dyes and carbon black since there are many that have polymerization inhibitory properties.

In addition, an example of a preferable method for treating dyes consists of polymerizing a polymerizable monomer in advance in the presence of dye followed by adding the resulting colored polymer to the polymerizable monomer composition. On the other hand, with respect to carbon black, in addition to treatment similar to that carried out on the above-mentioned dye, carbon black may be treated with a substance that reacts with a surface functional group of the carbon black (such as an organosiloxane).

Furthermore, the content of colorant is preferably from 3.0 parts by mass to 15.0 parts by mass based on 100.0 parts by mass of binder resin or polymerizable monomer.

In the present invention, the toner particle may contain a charge control agent as necessary. A known agent can be used for the above-mentioned charge control agent. A charge control agent that has a rapid charging speed and is able to stably maintain a constant amount of charge is particularly preferable. Moreover, in the case of producing the toner particles by a direct polymerization method, a charge control agent that has a low degree of polymerization inhibition and is substantially free of substances that are soluble in an aqueous medium is particularly preferable.

Examples of charge control agents that control toner particles to a negative charge include the following:

organic metal compounds and chelate compounds such as monoazo metal compounds, acetylacetone metal compounds, aromatic oxycarboxylic acids, aromatic dicarboxylic acids and oxycarboxylic acid- and dicarboxylic acid-based metal compounds. In addition, other examples include aromatic oxycarboxylic acids, aromatic mono- and polycarboxylic acids and metal salts thereof, anhydrides, esters and phenol derivatives such as bisphenol. Moreover, additional examples include urea derivatives, metal-containing salicylic acid-based compounds, metal-containing naphthoic acid-based compounds, boron compounds, quaternary ammonium salts and calixarene.

On the other hand, examples of charge control agents that control toner particles to a positive charge include the following:

nigrosine modification products obtained from nigrosine and compounds in the manner of fatty acid metal salts, guanidine compounds, imidazole compounds, quaternary ammonium salts in the manner of tributylbenzylammonium-1-hydroxy-4-naphthosulfonate or tetrabutylammonium tetrafluoroborate and analogues thereof in the form of onium salts and lake pigments thereof in the manner of phosphonium salts, triphenylmethane dyes and lake pigments thereof (with examples of laking agents including phosphotungstic acid, phosphomolybdic acid, phosphotungstomolybdic acid, tannic acid, lauric acid, gallic acid, ferricyanides and ferrocyanides), metal salts of higher fatty acids and resin-based charge control agents.

These charge control agents can be used alone or two or more types can be used in combination. Among these charge control agents, metal-containing salicylic acid-based compounds are preferable, and the metal thereof is preferably aluminum or zirconium in particular. The most preferable examples of charge control agents are aluminum 3,5-di-tert-butyl salicylate compounds.

In addition, a polymer having a sulfonic acid-based functional group is preferable as a resin-based charge control agent. Polymers having a sulfonic acid-based functional group refer to polymers or copolymers having a sulfonic acid group, sulfonate group or sulfonic acid ester group.

Examples of polymers or copolymers having a sulfonic acid group, sulfonate group or sulfonic acid ester group include highly polymerized compounds having a sulfonic acid group in a side chain thereof. Highly polymerized compounds in the form of styrene and/or styrene(meth) acrylic acid ester copolymers containing a sulfonic acid group-containing (meth)acrylamide-based monomer at a copolymerization ratio of 2% by mass or more and preferably 5% by mass or more, and have a glass transition temperature (Tg) of from 40° C. to 90° C., are preferable. Charged state stability improves at high humidity.

The above-mentioned sulfonic acid group-containing (meth)acrylamide-based monomer is preferably that represented by the following formula (X), and specific examples thereof include 2-acrylamido-2-methylpropanesulfonate and 2-methacrylamido-2-methylpropanesulfonate:

[Chemical Formula 9]

(X)

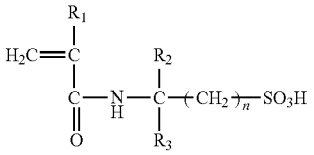

(wherein, $R_1$ represents a hydrogen atom or methyl group, $R_2$ and $R_3$ respectively and independently represent a hydrogen atom or alkyl group, alkenyl group, aryl group or alkoxy group having from 1 to 10 carbon atoms, and n represents an integer of from 1 to 10).

As a result of the above-mentioned polymer having a sulfonic acid group being contained in the toner particle at from 0.1 part by mass to 10.0 parts by mass based on 100 parts by mass of the binder resin, the charged state of the toner particle can be further improved.

The added amount of these charge control agents is preferably from 0.01 parts by mass to 10.00 parts by mass based on 100.00 parts by mass of the binder resin or polymerizable monomer.

The toner of the present invention can be a toner having various types of organic fine particles or inorganic fine particles externally added to the toner particle for the purpose of imparting various properties. The above-mentioned organic fine particles or inorganic fine particles preferably have a particle diameter that is 1/10 or less the weight-average particle diameter of the toner particle in consideration of durability when adding to the toner particle.

The following fine particles are used for the organic fine particles or inorganic fine particles:

(1) fluidity-imparting agents: silica, alumina, titanium oxide, carbon black and carbon fluoride;

(2) abrasives: strontium titanate, metal oxides in the manner of cerium oxide, alumina, magnesium oxide or chromium oxide, nitrides in the manner of silicon nitride, carbides in the manner of silicon carbide and metal salts in the manner of calcium sulfate, barium sulfate or calcium carbonate;

(3) lubricants: fluorine-based resin powders in the manner of vinylidene fluoride or polytetrafluoroethylene, and fatty acid metal salts in the manner of zinc stearate or calcium stearate; and, (4) charge controlling particles: metal oxides in the manner of tin oxide, titanium oxide, zinc oxide, silica or alumina and carbon black.

Organic fine particles or inorganic fine particles are used to treat the surface of the toner particle in order to improve toner flowability and unify toner charge. Since subjecting the organic fine particles or inorganic fine particles to hydrophobic treatment makes it possible to adjust toner charging performance and achieve improvement of charging characteristics in high humidity environments, organic fine particles or inorganic fine particles that have undergone hydrophobic treatment are used preferably.

Examples of treatment agents used in hydrophobic treatment of the organic fine particles or inorganic fine particles include unmodified silicone varnish, various types of modified silicone varnish, unmodified silicone oil, various types of modified silicone oil, silane compounds, silane coupling agents, other organic silicon compounds and organic titanium compounds. These treatment agents may be used alone or in combination.

Among these, inorganic fine particles treated with silicone oil are preferable. More preferably, inorganic fine particles are treated with silicone oil either simultaneous or subsequent to hydrophobic treatment with a coupling agent. Hydrophobically treated inorganic fine particles treated with silicone oil maintain a high amount of toner charge even in high humidity environments, and are preferable in terms of reducing selective development.

The added amount of these organic fine particles or inorganic fine particles is preferably from 0.01 parts by mass to 10.00 parts by mass, more preferably from 0.02 parts by mass to 5.00 parts by mass, and even more preferably from 0.03 parts by mass to 1.00 part by mass based on 100.00 parts by mass of toner particle. Adjusting to the proper added amount improves contamination of members caused by the organic fine particles or inorganic fine particles becoming embedded in or released from the toner particle. These organic fine particles or inorganic fine particles may be used alone or a plurality thereof may be used in combination.

In the present invention, the BET specific surface area of the organic fine particles or inorganic fine particles is preferably from 10 $m^2/g$ to 450 $m^2/g$.

The BET specific surface area of the organic fine particles or inorganic fine particles can be determined by low-temperature gas absorption using the dynamic constant pressure method in accordance with the BET method (and preferably the BET multipoint method). For example, BET specific surface area ($m^2/g$) can be calculated by allowing nitrogen gas to be adsorbed onto the surface of a sample and measuring using the BET multipoint method using a specific surface area measuring instrument (GEMENI® 2375 Ver. 5.0, Shimadzu Corp.).

The organic fine particles or inorganic fine particles may be strongly adhered or attached to the surface of the toner particle. Examples of externally added mixers for strongly adhering or attaching the organic fine particles or inorganic fine particles to the surface of the toner particle include a HENSCHEL® mixer, mechano-fusion mixer, cyclomixer, turbulizer, flexomix mixer, hybridization mixer, mechanohybrid mixer and nobilta mixer.

In addition, the organic fine particles or inorganic fine particles can be strongly adhered or attached by increasing rotating speed or prolonging treatment time.

The following provides an explanation of physical properties of the toner.

In the toner of the present invention, viscosity at 80° C. as measured with a capillary rheometer of the constant load extrusion type is preferably from at least 1,000 Pa·s to not more than 40,000 Pa·s. The toner has superior low-temperature fixability as a result of the viscosity at 80° C. being from at least 1,000 Pa·s to not more than 40,000 Pa·s. The viscosity at 80° C. is more preferably from at least 2,000 Pa·s to not more than 20,000 Pa·s. Furthermore, in the present invention, the above-mentioned viscosity at 80° C. can be adjusted according to the added amount of low-molecular weight resin and the type of monomer, amount of initiator, reaction temperature and reaction time during production of the binder resin.

The viscosity of the toner at 80° C. as measured with a capillary rheometer of the constant load extrusion type can be determined according to the method indicated below.

Measurement is carried out under the following conditions using the CFT-500D Flow Tester (Shimadzu Corp.) for the apparatus.

Sample: Approximately 1.0 g of toner is weighed out followed by molding for 1 minute using a pressure molding machine at a load of 100 kg/cm$^2$ to prepare the sample.

Die opening diameter: 1.0 mm

Die length: 1.0 mm

Cylinder pressure: $9.807\times10^5$ (Pa)

Measurement mode: Temperature ramp method

Ramp rate: 4.0° C./min

According to the above-mentioned method, viscosity at 80° C. (Pa·s) is determined by measuring toner viscosity (Pa·s) over a range of 30° C. to 200° C. That value is the viscosity at 80° C. as measured with a capillary rheometer of the constant load extrusion type.

The weight-average particle diameter (D4) of the toner of the present invention is preferably from 4.0 μm to 9.0 μm, more preferably from 5.0 μm to 8.0 μm, and even more preferably from 5.0 μm to 7.0 μm.

The glass transition temperature (Tg) of the toner of the present invention is preferably from at least 35° C. to not more than 100° C., more preferably from at least 40° C. to not more than 80° C., and even more preferably from at least 45° C. to not more than 70° C. As a result of the glass transition temperature being within the above-mentioned ranges, blocking resistance, cold offset resistance and transparency of transmitted images of overhead projector film can be further improved.

The content of tetrahydrofuran (THF)-insoluble matter of the toner of the present invention is preferably less than 50.0% by mass, more preferably from at least 0.0% by mass to less than 45.0% by mass, and even more preferably from at least 5.0% by mass to less than 40.0% by mass with respect to toner components other than the toner colorant and inorganic fine particles. Low-temperature fixability can be improved by making the content of THF-insoluble matter to be less than 50.0% by mass.

The above-mentioned content of THF-insoluble matter of the toner refers to the mass ratio of ultra-high-molecular weight polymer component (substantially cross-linked polymer) that has become insoluble in THF solvent. In the present invention, the content of THF-insoluble matter of the toner refers to the value measured as indicated below.

1.0 g of toner is weighed out (W1 g) and placed in a filter paper thimble (No. 86R (trade name), Toyo Roshi Kaisha Ltd.), and the filter paper thimble is placed in a Soxhlet extractor and extracted for 20 hours using 200 mL of THF as solvent to concentrate the soluble matter extracted by the solvent, followed by vacuum-drying for several hours at 40° C. and weighing the amount of the THF-soluble resin component (W2 g). The weight of components other than the resin component such as colorant in the toner particles is designated as (W3 g). The content of THF-insoluble matter is then determined from the equation indicated below.

$$\text{Content of THF-insoluble matter(mass \%)}=\{(W1-(W3+W2))/(W1-W3)\}\times100$$

The content of THF-insoluble matter in the toner can be adjusted according to the degree of polymerization and degree of crosslinking of the binder resin.

In the present invention, the weight-average molecular weight (Mw) (to also be referred to as the "weight-average molecular weight of the toner") of tetrahydrofuran (THF)-soluble matter of the toner as measured by gel permeation chromatography (GPC) is preferably from at least 5,000 to not more than 50,000. Blocking resistance and development durability as well as low-temperature fixability and high image gloss can be realized by making the weight-average molecular weight (Mw) of the toner to be within the above-mentioned range. Furthermore, in the present invention, the weight-average molecular weight (Mw) of the toner can be adjusted according to the amount added and weight-average molecular weight (Mw) of the low-molecular weight resin, and the reaction temperature, reaction time, amount of polymerization initiator, amount of chain transfer agent and amount of crosslinking agent during production of toner particles.

In addition, in the present invention, in the molecular weight distribution of tetrahydrofuran (THF)-soluble matter of the toner as measured by gel permeation chromatography (GPC), the ratio [Mw/Mn] of the weight-average molecular weight (Mw) to the number-average molecular weight (Mn) is preferably from at least 5.0 to not more than 100.0 and more preferably from at least 5.0 to not more than 30.0. The size of the fixable temperature range can be increased by making the ratio [Mw/Mn] to be within the above-mentioned ranges.

(Methods for Measuring Physical Properties of Toner or Toner Particle)

(Preparation of Tetrahydrofuran (THF)-Insoluble Matter of Toner Particle)

Tetrahydrofuran (THF)-insoluble matter of the toner particle was prepared as indicated below.

10.0 g of toner particle was weighed out, placed in a filter paper thimble (No. 86R (trade name), Toyo Roshi Kaisha Ltd.), placed in a Soxhlet extractor and extracted for 20 hours using 200 mL of THF as solvent, followed by vacuum-drying the residue in the filter paper thimble for several hours at 40° C. and using the resulting dried residue as THF-insoluble matter of the toner particle for use in NMR measurement.

Furthermore, in the present invention, in the case the above-mentioned organic fine particles or inorganic fine particles have been added externally to the toner, the toner particle is obtained after removing the above-mentioned organic fine particles or inorganic fine particles according to the method indicated below.

160 g of sucrose (Kishida Chemical Co., Ltd.) are added to 100 mL of ion exchange water followed by dissolving while heating the ion exchange water to prepare a concentrated sucrose solution. 31.0 g of the above-mentioned concentrated sucrose solution and 6 mL of Contaminon N (trade name) (10% by mass aqueous solution of neutral detergent for cleaning precision measuring instruments having a pH of 7 and composed of a nonionic surfactant, anionic surfactant and an organic builder, Wako Pure Chemical Industries, Ltd.) are placed in a centrifuge tube to produce a dispersion. 1.0 g of toner is added to this dispersion and clumps of the toner are broken up with a spatula.

The centrifuge tube is shaken for 20 minutes with a shaker at 350 strokes per minute (spm). After shaking, the solution is transferred to a glass tube (50 mL) for a swing rotor and separated with a centrifugal separator for 30 minutes at 3500 rpm. After visually confirming that the toner and aqueous solution have adequately separated, the toner separated in the uppermost layer is collected with a spatula and the like. After filtering the collected toner with a vacuum filter, the toner is dried for 1 hour or more with a dryer. The dried product is crushed with a spatula to obtain toner particle.

(Confirmation of Partial Structure Represented by Formula (1) or Formula (2))

The method used to confirm the partial structure represented by formula (1) or formula (2) is as indicated below. The presence or absence of a methine group (>CH—) bound to a silicon atom of formula (1) or the presence or absence of a methylene group (—$CH_2$—), ethylene group (—$CH_2$—$CH_2$—) or phenylene group (-Ph-) bound to a silicon atom of formula (2) was confirmed by $^{13}$C-NMR. The apparatus and measurement conditions used are indicated below.

(Measurement Conditions)

Apparatus: Bruker Avance III 500

Probe: 4 mm MAS BB/1H

Measuring temperature: Room temperature

Sample rotating speed: 6 kHz

Sample: 150 mg of measurement sample (the above-mentioned THF-insoluble matter of toner particle for NMR measurement) were placed in a sample tube having a diameter of 4 mm.

More specifically, confirmation was made based on a signal (25 ppm) of a methine group (>CH—) bound to a silicon atom of formula (1). When a signal was able to be confirmed, the partial structure represented by formula (1) was determined to be "present".

Moreover, confirmation was made based on a signal of a methylene group (—$CH_2$—), ethylene group (—$CH_2$—$CH_2$—) or phenylene group (-Ph-) bound to a silicon atom of formula (2). When a signal was able to be confirmed, the partial structure represented by formula (2) was determined to be "present".

($^{13}$C-NMR (Solid) Measurement Conditions)

Measured nucleus frequency: 125.77 MHz

Standard substance: Glycine (external standard: 176.03 ppm)

Observation width: 37.88 kHz

Measurement method: CP/MAS

Contact time: 1.75 msec

Repetition time: 4 sec

Cumulative number: 2048

LB value: 50 Hz (Confirmation and Measurement of Proportion of Silicon Atom in Organic Silicon Polymer Having Structure Represented by the —$SiO_{3/2}$)

The proportion of a silicon atom in the organic silicon polymer having a structure represented by the —$SiO_{3/2}$ was confirmed by $^{29}$Si-NMR.

($^{29}$Si-NMR (Solid) Measurement Conditions)

(Measurement Conditions)

Apparatus: Bruker Avance III 500

Probe: 4 mm MAS BB/1H

Measuring temperature: Room temperature

Sample rotating speed: 6 kHz

Sample: 150 mg of measurement sample (THF-insoluble matter of toner particle for NMR measurement) were placed in a sample tube having a diameter of 4 mm.

Measured nucleus frequency: 99.36 MHz

Standard substance: DSS (external standard: 1.534 ppm)

Observation width: 29.76 kHz

Measurement method: DD/MAS, CP/MAS $^{29}$Si 90°

Pulse width: 4.00 μsec @−1 dB

Contact time: 1.75 msec to 10 msec

Repetition time: 30 sec (DD/MAS), 10 sec (CP/MAS)

Cumulative number: 2048

LB value: 50 Hz

The proportion [ST3] (%) of a silicon atom in the organic silicon polymer having a structure (T3 structure) represented by the —$SiO_{3/2}$ bound to a methine group (>CH—), methylene group (—$CH_2$—), ethylene group (—$CH_2$—$CH_2$—) or phenylene group (-Ph-) relative to a silicon atom in the organic silicon polymer contained in the toner particle is determined in the manner indicated below.

In $^{29}$Si-NMR measurement of tetrahydrofuran (THF)-insoluble matter of the toner particle, when the area obtained by subtracting silane monomer from the total peak area of the organic silicon polymer is defined as SS, and the peak area of structures (T3 structures) represented by the —$SiO_{3/2}$ bound to a methine group (>CH—), methylene group (—$CH_2$—), ethylene group (—$CH_2$—$CH_2$—) or phenylene group (-Ph-) is defined as S(t3), then [ST3] (%) is represented by the equation indicated below.

$$ST3(\%)=\{S(t3)/SS\}\times 100$$

Following $^{29}$Si-NMR measurement of THF-insoluble matter of the toner particle, peaks were resolved to an X4 structure, in which the number of $O_{1/2}$ bound to silicon represented by the following general formula (X4) is 4.0, X3 structure, in which the number of $O_{1/2}$ bound to silicon represented by the following general formula (X3) is 3.0, X2 structure, in which the number of $O_{1/2}$ bound to silicon represented by the following general formula (X2) is 2.0, X1 structure, in which the number of $O_{1/2}$ bound to silicon represented by the following general formula (X1) is 1.0, and T3 structure by curve-fitting a plurality of silane components having different substituents and linking groups in the toner particle, followed by calculating the mol percentage (mol %) of each component from the area ratio of each peak:

[Chemical Formula 10]

(X4)

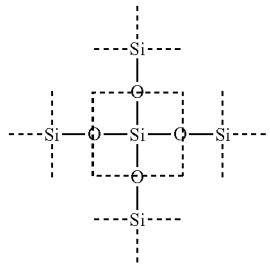

-continued

[Chemical Formula 11]

(X3)

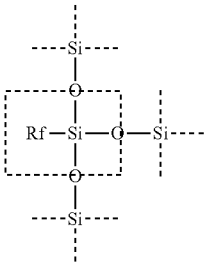

(wherein, Rf represents an organic group, halogen atom, hydroxyl group or alkoxy group bound to silicon),

[Chemical Formula 12]

(X2)

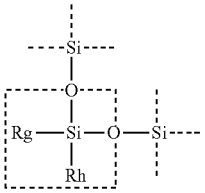

(wherein, Rg and Rh represent organic groups, halogen atoms, hydroxyl groups or alkoxy groups bound to silicon),

[Chemical Formula 13]

(X1)

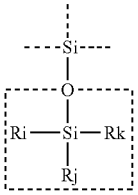

(wherein, Ri, Rj and Rk represent organic groups, halogen atoms, hydroxyl groups or alkoxy groups bound to silicon).

Figure 2:
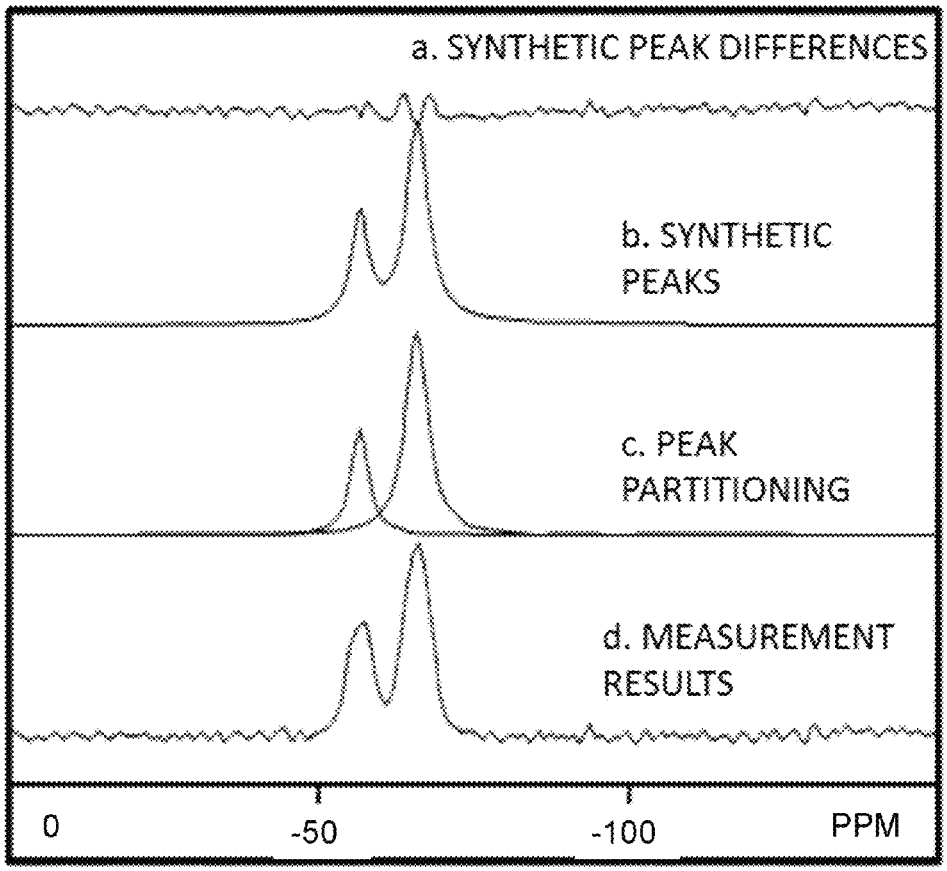
FIG. 2 is a $^{29}$Si-NMR measurement chart of toner particles of the present invention.

Excalibur for Windows (trade name) Version 4.2 (EX series) software for the JNM-EX400 manufactured by JEOL Ltd. is used for curve fitting. Measurement data is imported by clicking "1D Pro" from the menu icon. Next, "Curve fitting function" is selected from "Command" in the menu bar to carryout curve fitting. An example thereof is shown in FIG. 2. Peak partitioning is carried out so that the peaks in the synthetic peak differences (a), which are the differences between the synthetic peaks (b) and the measurement results (d), become the smallest.

The area of the X1 structure, the area of the X2 structure, the area of the X3 structure and the area of the X4 structure are determined followed by determining SX1, SX2, SX3 and SX4 from the equations indicated below.

(Confirmation of Partial Structures of T3, X1, X2, X3 and X4)

The partial structures of T3, X1, X2, X3 and X4 can be confirmed by $^{1}$H-NMR, $^{13}$C-NMR and $^{29}$Si-NMR.

Following NMR measurement, the peaks were resolved to an X1 structure, X2 structure, X3 structure, X4 structure and T3 structure by curve fitting a plurality of silane components having different substituents and linking groups in the toner particle, followed by calculating the mol % of each component from the area ratio of each peak.

In the present invention, silane monomer is determined based on chemical shift values, and in $^{29}$Si-NMR measurement of the toner particle, the total of the area of the X1 structure, the area of the X2 structure, the area of the X3 structure and the area of the X4 structure, obtained by excluding monomer components from total peak area, was taken to be the total peak area (SS) of the organic silicon polymer.

$$SX1+SX2+SX3+SX4=1.00$$

SX1={area of X1 structure/(area of X1 structure+area of X2 structure+area of X3 structure+area of X4 structure)}

SX2={area of X2 structure/(area of X1 structure+area of X2 structure+area of X3 structure+area of X4 structure)}

SX3={area of X3 structure/(area of X1 structure+area of X2 structure+area of X3 structure+area of X4 structure)}

SX4={area of X4 structure/(area of X1 structure+area of X2 structure+area of X3 structure+area of X4 structure)}

ST3={area of T3 structure/(area of X1 structure+area of X2 structure+area of X3 structure+area of X4 structure)}

The chemical shift values of silicon in the X1 structure, X2 structure, X3 structure, X4 structure and T3 structure are indicated below.

Example of X1 structure (Ri=Rj=—$OCH_3$, Rk=—CH—$CH_2$—): Broad band peak from −43 ppm to −63 ppm Example of X2 structure (Rg=—$OCH_3$, Rh=—CH—$CH_2$—): −71 ppm Example of X3 structure and T3 structure (Rf=—CH—$CH_2$—): −81 ppm In addition, the chemical shift value of silicon in the case an X4 structure is present is indicated below.

X4 structure: −108 ppm (Measurement of Average Thickness Dav. of Surface Layer having Organic Silicon Polymer of Toner particle and Proportion of Surface Layer having Organic Silicon Polymer having Thickness of not more than 5.0 nm as Measured by Cross-Sectional Observation of Toner Particle Using Transmission Electron Microscope (TEM))

Observation of cross-sections of the toner particle of the present invention was carried out using the method indicated below.

The specific method used to observe toner particle cross-sections consists of dispersing the toner particles in normal temperature-curable epoxy resin followed by allowing to stand for 2 days in an atmosphere at 40° C. to allow the epoxy resin to cure. A thin section of sample is then cut out from the resulting cured product using a microtome equipped with a diamond blade. This sample is magnified at a magnification factor of 10,000 to 100,000 with a transmission electron microscope (trade name: Tecnai TF20XT Electron Microscope, FEI Co.) (TEM) followed by observing a cross-section of the toner particles.

In the present invention, confirmation is made by utilizing the fact that contrast becomes brighter as atomic weight increases by utilizing differences in atomic weights of atoms present in the resin and organic silicon polymer used. Moreover, staining with triruthenium tetraoxide and triosmium tetraoxide is used to generate contrast between materials. In the present invention, thinly sliced samples were placed in a chamber and stained at a density of 5 and staining time of 15 minutes using a vacuum electron staining apparatus (trade name: VSC4R1H, Filgen, Inc.).

Circle-equivalent diameter Dtem of the particle used in this measurement was determined from cross-section of the toner particle obtained from the above-mentioned TEM micrographs, and that value was taken to be contained within a width of ±10% of the weight-average particle diameter of the toner particle as determined by the method to be subsequently described.

Bright field images of toner particle cross-sections are acquired at an accelerating voltage of 200 kV using a transmission electron microscope (trade name: Tecnai TF20XT Electron Microscope, FEI Co.) as was previously described. Next, EF mapping images are acquired of the Si—K edge (99 eV) according to the three window method using the GIF Tridiem EELS detector manufactured by Gatan Corp. to confirm the presence of the organic silicon polymer in the surface layer. Next, a toner particle cross-section is equally divided into 16 sections centering on the intersection of the long axis L of the toner particle cross-section and the axis L90 that passes through the center of the long axis L and is perpendicular thereto for a single toner particle in which the circle-equivalent diameter Dtem is contained in a width of ±10% of the weight-average particle diameter of the toner particle (see FIG. 1). Next, the dividing axes from the above-mentioned center towards the surface layer of the toner particle having the organic silicon polymer are respectively designated as An (n=1 to 32), the length of the dividing axes is designated as RAn, and the thickness of the surface layer having the organic silicon polymer of a toner particle that contains the organic silicon polymer is designated as FRAn. The average thickness Dav. of the surface layer having the organic silicon polymer of a toner particle that contains the organic silicon polymer is determined for 32 locations on the above-mentioned dividing axes. Moreover, the proportion of the number of dividing axes for which the thickness of the surface layer having the organic silicon polymer of a toner particle that contains the organic silicon polymer is not more than 5.0 nm is determined for each of the 32 dividing axes present.

In the present invention, 10 particles were measured to determine the average followed by calculating the average value per toner particle.

(Circle-Equivalent Diameter (Dtem) Determined from Cross-Section of Toner Particle Obtained from Transmission Electron Microscope (TEM) Micrograph)

Circle-equivalent diameter (Dtem) determined from cross-sections of the toner particle obtained from TEM micrographs is determined using the method indicated below. First, circle-equivalent diameter Dtem determined from the cross-section of a single toner particle obtained from a TEM micrograph is determined in accordance with the equation indicated below.

$$[\text{Circle-equivalent diameter (Dtem) determined from toner particle cross-section obtained from TEM micrograph}]=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$$

Circle-equivalent diameter is determined for 10 toner particles, the average value per particle is calculated, and that value is taken to be the circle-equivalent diameter (Dtem) determined from cross-section of the toner particle.

(Measurement of Average Thickness (Dav.) of Surface Layer of Toner Particle that has Organic Silicon Polymer)

The average thickness (Dav.) of the surface layer of the toner particle that has the organic silicon polymer is determined using the method indicated below.

First, the average thickness $D_{(n)}$ of the surface layer of a single toner particle having the organic silicon polymer is determined using the method indicated below.

$$D_{(n)}=(\text{total thickness of surface layer having organic silicon polymer at 32 locations on dividing axes})/32$$

The average thickness $D_{(n)}$(n=1 to 10) of the surface layer of the toner particle that has the organic silicon polymer is determined for 10 toner particles to obtain an average, the average value per toner particle is calculated, and that value is taken to be the average thickness (Dav.) of the surface layer of the toner particle that has the organic silicon polymer.

$$Dav.=\{D_{(1)}+D_{(2)}+D_{(3)}+D_{(4)}+D_{(5)}+D_{(6)}+D_{(7)}+D_{(8)}+D_{(9)}+D_{(10)}\}/10$$

(Measurement of Proportion of Surface Layer having Organic Silicon Polymer having Thickness of not more than 5.0 nm)

$$[\text{Proportion of surface layer having organic silicon polymer having thickness of not more than 5.0 nm } (FRAn)]=[\{\text{Number of dividing axes in which thickness of surface layer having organic silicon polymer } (FRAn) \text{ is not more than 5.0 nm}\}/32]\times 100$$

This calculation was carried out for 10 toner particles, the average value of the proportion of the thickness of the surface layer having the organic silicon polymer (FRAn) being not more than 5.0 nm is determined for the resulting 10 toner particles, and that value is taken to be the proportion in which the thickness (FRAn) of the surface layer having the organic silicon polymer of the toner particle is not more than 5.0 nm.

(Density of Silicon Atom Present in Surface of Toner Particle (atom %))

The density of a silicon atom [dSi] (atom %), the density of a carbon atom [dC] (atom %), the density of a hydrogen atom [dH] (atom %) and the density of a sulfur atom [dS] (atom %) present in the surface of the toner particle were calculated by carrying out a surface composition analysis using an X-ray photoelectron spectroscopic analysis (ESCA: Electron Spectroscopy for Chemical Analysis).

In the present invention, the ESCA apparatus and measurement conditions are as indicated below.

Apparatus used: Quantum 2000, Ulvac-Phi Inc.

X-ray photoelectron spectrometer measurement conditions: X-ray source: Al Kα

X-rays: 100 μm, 25 W, 15 kV

Raster: 300 μm×200 μm

Pass energy: 58.70 eV

Step size: 0.125 eV

Neutralizing electron gun: 20 μA, 1 V

Ar ion gun: 7 mA, 10 V

Number of sweeps: 15 for Si, 10 for C, 5 for H and 5 for S

In the present invention, the density of the silicon atom [dSi], the density of the carbon atom [dC], the density of the hydrogen atom [dH] and the density of the sulfur atom [dS] (all in atom %) present in the surface of the toner particle were calculated from the measured peak intensities of each element using the relative sensitivity factors provided by Phi Inc.

(Measurement Method of Weight-Average Molecular Weight (Mw), Number-Average Molecular Weight (Mn) and Main Peak Molecular Weight (Mp) of Toner (Particle) and Various Resins)

The weight-average molecular weight (Mw), number-average molecular weight (Mn) and main peak molecular weight (Mp) of toner (particle) and various resins are measured according to the following conditions using gel permeation chromatography (GPC).

(Measurement Conditions)

Column (Showa Denko K.K.): Seven columns consisting of the Shodex GPC KF-801, KF-802, KF-803, KF-804, KF-805, KF-806 and KF-807 (diameter: 8.0 mm, length: 30 cm)

Eluent: Tetrahydrofuran (THF)

Temperature: 40° C.

Flow rate: 0.6 mL/min

Detector: RI

Sample concentration and volume: 0.1% by mass, 10 μL (Sample Preparation)

0.04 g of the measurement target (toner (particle) or various types of resin) are dispersed and dissolved in 20 mL of tetrahydrofuran followed by allowing to stand undisturbed for 24 hours, filtering with a 0.2 μm filter (trade name: Myshori Disk H-25-2, Tosoh Corp.) and using the filtrate as sample.

A molecular weight calibration curve prepared using monodispersed polystyrene standard samples is used for the calibration curve. TSK standard polystyrenes manufactured by Tosoh Corp. consisting of F-850, F-450, F-288, F-128, F-80, F-40, F-20, F-10, F-4, F-2, F-1, A-5000, A-2500, A-1000 and A-500 are used as standard polystyrene samples for calibration curve preparation. At this time, standard polystyrene samples for at least ten locations on the calibration curve are used.

When preparing GPC molecular weight distribution, measurement is begun from the starting point where the chromatogram rises from the baseline on the high molecular weight side and is continued to a molecular weight of about 400 on the low molecular weight side.

(Measurement Method of Glass Transition Temperature (Tg), Melting Point and Calorimetric Integral Value of Toner (Particle) and Various Resins)

The glass transition temperature (Tg), melting point and calorimetric integral value of the toner (particle) and various resins are measured according to the procedure indicated below using an M-DSC differential scanning calorimeter (DSC) (trade name: T2000, TA Instruments Inc.). 3 mg of sample to be measured (toner (particle) or various resins) are accurately weighed. The sample is placed in an aluminum pan (pan made of aluminum), an empty aluminum pan is used as a reference, and measurement is carried out at normal temperature and normal humidity over a measuring temperature range of 20° C. to 200° C. at a ramp rate of 1° C./min. At this time, measurements are carried out at a modulation amplitude of ±0.5° C. and frequency of 1/min. Glass transition temperature (Tg: ° C.) is calculated from the resulting reversing heat flow curve. Tg is determined by defining the central value of the intersections of the baseline before and after absorption of heat and the tangent of the curve resulting from absorption of heat as Tg (° C.).

The temperature (° C.) at the top of the endothermic main peak on the endothermic chart when raising the measurement temperature by DSC is taken to be the melting point (° C.).

Figure 3:
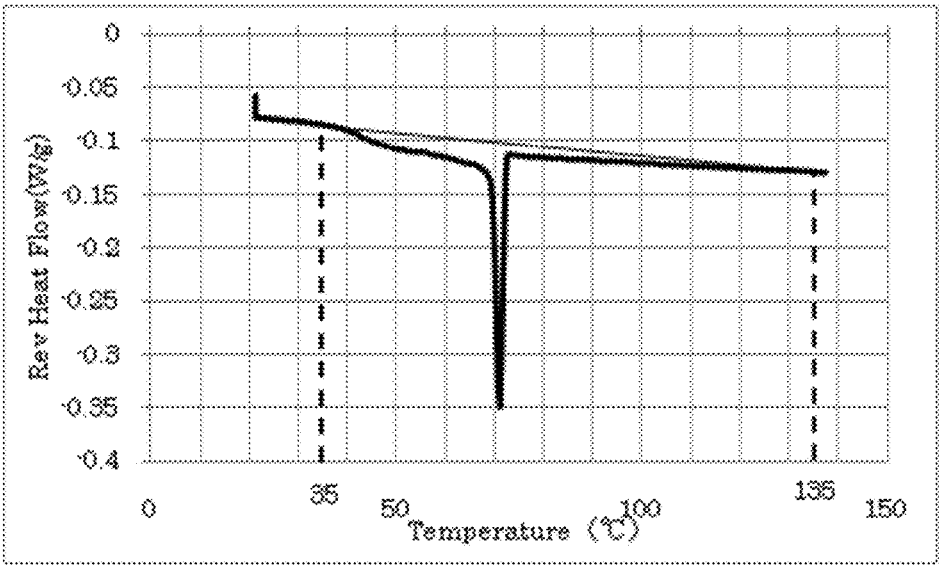
FIG. 3 is a drawing showing a reversing heat flow curve obtained by DSC measurement of the toner of the present invention.

In addition, the calorimetric integral value (J/g) per gram of toner (particle) represented by the peak area of the endothermic main peak is measured on the endothermic chart when raising the measurement temperature by DSC. An example of a reversing heat flow curve obtained by DSC measurement of the toner (particle) is shown in FIG. 3.

The calorimetric integral value (J/g) is determined using a reversing heat flow curve obtained from the above-mentioned measurement. The Universal Analysis 2000 for Windows (trade name) 2000/XP Version 4.3A (TA Instruments Inc.) analytical software is used for calculations, and calorimetric integral value (J/g) is determined from the region surrounded by a line connecting measurement points at 35° C. and 135° C. and the endothermic curve using the Integral Peak Linear function.

Furthermore, in the case two or more compounds are present in the toner (particle) that have a melting point, the respective compounds are analyzed after separating and purifying by the re-precipitation method since their melting points may overlap. In addition, the structure is determined based on the mass spectra of decomposition products and the decomposition temperature by TGA-GC-MASS using a thermogravimetric analyzer equipped with a mass spectrometer. Moreover, detailed structures and compositions are determined by $^{1}$H-NMR, $^{13}$C-NMR and IR.

(Measurement Method of Weight-Average Particle Diameter (D4) and Number-Average Particle Diameter (D1) of Toner (Particle))

The weight-average particle diameter (D4) and number-average particle diameter (D1) of the toner (particle) were calculated by measuring with 25,000 effective measurement channels using a precision particle size distribution analyzer according to the pore electrical resistance method equipped with a 100 μm aperture tube (trade name: Coulter Counter Multisizer 3, Beckman Coulter Inc.) and dedicated software provided with the analyzer for setting measurement conditions and analyzing measurement data (trade name: Beckman Coulter Multisizer 3 Version 3.51, Beckman Coulter Inc.) followed by analyzing the measurement data.

The electrolyte solution used in measurement consisted of special grade sodium chloride dissolved in ion exchange water to a concentration of about 1% by mass, and, for example, Isoton II (trade name) manufactured by Beckman Coulter Inc. can be used.

Furthermore, the above-mentioned dedicated software is set in the manner indicated below prior to carrying out measurement and analysis.

The total number of counts of the control mode is set to 50,000 particles on the "Change Standard Measurement Method (SOM) Screen" of the above-mentioned dedicated software, the number of measurements is set to 1, and the value obtained using "Standard particle: 10.0 μm." (Beckman Counter Inc.) is used for the Kd value. The threshold and noise level are set automatically by pressing the threshold/noise level measurement button. In addition, the current is set to 1600 μA, the gain is set to 2, the electrolyte is set to Isoton II (trade name), and a check is entered for flushing the aperture tube after measurement.

Bin interval is set to logarithmic particle diameter, particle diameter bin is set to the 256 particle diameter bin, and particle diameter range is set to 2 μn to 60 μm on the "Pulse to Particle Diameter Conversion Setting Screen" of the dedicated software.

A detailed description of the measurement method is provided below.

(1) About 200 mL of the above-mentioned electrolyte solution are placed in a glass, 250 mL round-bottom beaker for use with the Multisizer 3, the beaker is placed in a sample stand, and the contents are stirred by rotating the stirrer rod counter-clockwise at 24 revolutions/second. The inside of the aperture tube is cleaned and removed of air bubbles with the "Aperture Flush" function of the dedicated software.

(2) About 30 mL of the above-mentioned electrolyte solution are placed in a glass, 100 mL flat-bottom beaker followed by the addition of about 0.3 mL of a dispersing agent in the form of Contaminon N (trade name) (10% by mass aqueous solution of neutral detergent for cleaning precision measuring instruments having a pH of 7 and composed of a nonionic surfactant, anionic surfactant and an organic builder, Wako Pure Chemical Industries, Ltd.) diluted three-fold by mass with ion exchange water.

(3) A prescribed amount of ion exchange water is placed in the water tank of a ultrasonic disperser (trade name: Ultrasonic Dispersion System Tetora 150, Nikkaki Bios Co., Ltd.) having two internal oscillators having oscillation frequencies of 50 kHz shifted out of phase by 180° and an electrical output of 120 W, and about 2 mL of Contaminon N (trade name) are added to this water tank.

(4) The beaker described in (2) above is set in the beaker mounting hole of the above-mentioned ultrasonic disperser followed by operation of the ultrasonic disperser. The height of the beaker is adjusted so that the oscillating state of the liquid surface of the electrolyte solution in the beaker reaches a maximum.

(5) About 10 mg of toner (particle) are added a little at a time to the above-mentioned electrolyte solution with the ultrasonic waves radiating onto the electrolyte solution in the beaker described in (4) above, and are then dispersed. Ultrasonic dispersion treatment is further continued for 60 seconds. Furthermore, in carrying out ultrasonic dispersion, the water temperature of the water tank is suitably adjusted so as to be from 10° C. to 40° C.

(6) The electrolyte solution described in (5) above having the toner (particle) dispersed therein is dropped into the round-bottom beaker described in (1) above placed on the sample stand using a pipette, and the measured concentration is adjusted to about 5%. Measurement is then carried out until the number of measured particles reaches 50,000.

(7) Measurement data is analyzed with the above-mentioned dedicated software provided with the analyzer to calculate the weight-average molecular weight (D4). Furthermore, when the analyzer is set to graph/volume % with the dedicated software, the "average diameter" on the Analysis/Volumetric Statistical Value (Arithmetic Mean) screen corresponds to the weight-average molecular weight (D4), and when the analyzer is set to "graph/number %" with the dedicated software, the "average diameter" on the "Analysis/Number Statistical Value (Arithmetic Mean)" screen corresponds to the number-average particle diameter (D1).

Although the following provides a more detailed explanation of the present invention by listing examples thereof, the present invention is not limited by these examples. Furthermore, the numbers of parts indicated in the following formulations indicate parts by mass unless specifically indicated otherwise.

Production Example of Polyester Resin (1)

1,9-nonanediol: 471.8 parts by mass (0.53 mol %)
Sebacic acid: 528.2 parts by mass (0.47 mol %)
Total amount: 1,000 parts by mass The above-mentioned monomers were charged into an autoclave together with an esterification catalyst, a pressure reducing device, water separating device, nitrogen gas introduction device, temperature measuring device and stirring device were attached to the autoclave, and a reaction was carried out in accordance with ordinary methods at 210° C. in a nitrogen atmosphere under reduced pressure. The reaction was terminated after sampling the reaction product and confirming that the weight-average molecular weight had reached the desired molecular weight to obtain polyester resin (1).

The weight-average molecular weight (Mw) of the resulting polyester resin was 16,000, the hydroxyl value was 3.5 mgKOH/g, the acid value was 2.8 mgKOH/g and the melting point was 78.9° C. The physical properties of polyester resin (1) are shown in Table 1.

Production Example of Polyester Resin (2)

Polyester resin (1): 500 parts by mass

Acrylic acid: 25 parts by mass

The above-mentioned raw materials were charged into an autoclave together with an esterification catalyst, a pressure reducing device, water separating device, nitrogen gas introduction device, temperature measuring device and stirring device were attached to the autoclave, and a reaction was carried out in accordance with ordinary methods at 210° C. in a nitrogen atmosphere under reduced pressure to obtain a reactive polyester resin.

Reactive polyester resin: 190.0 parts by mass

Styrene: 10.0 parts by mass

Xylene: 150.0 parts by mass

Each of the above-mentioned components was placed in a four-mouth flask and after adequately replacing the inside of the flask with nitrogen and raising the temperature to 150° C. while stirring, 0.05 parts by mass of Perbutyl D (10 hour half-life temperature: 54.6° C., NOF Corp.) were dropped therein. Moreover, polymerization was terminated after holding for 10 hours while refluxing with xylene followed by distilling off the solvent under reduced pressure to obtain polyester resin (2).

The weight-average molecular weight (Mw) of polyester resin (2) was 17,800, the hydroxyl value was 0.7 mgKOH/g, the acid value was 2.0 mgKOH/g and the melting point was 76.1° C. The physical properties of polyester resin (2) are shown in Table 1.

Production Example of Polyester Resin (3)

Polyester resin (3) was obtained in the same manner as the production example of polyester resin (2) with the exception of changing the 10.0 parts by mass of styrene to 30.0 parts by mass and changing the 0.10 parts by mass of Perbutyl D (10 hour half-life temperature: 54.6° C., NOF Corp.) to 0.30 parts by mass.

The weight-average molecular weight (Mw) of polyester resin (3) was 19,300, the hydroxyl value was 0.6 mgKOH/g, the acid value was 2.1 mgKOH/g and the melting point was 70.3° C. The physical properties of polyester resin (3) are shown in Table 1.

Polyester Resins (4) to (14)

Polyester resins (4) to (14) were obtained in the same manner as the production example of polyester resin (1) with the exception of changing the use of 0.53 mol % of 1,9-nonanediol and 0.47 mol % of sebacic acid to the compositions shown in Table 1. The physical properties of polyester resins (4) to (14) are shown in Table 1.

TABLE 1

| | | Polyester resin no. | | | | | | |
|---|---|---|---|---|---|---|---|---|
| | | (1) | (2) | (3) | (4) | (5) | (6) | (7) |
| Alcohol component (molar ratio) | 1,4-butanediol | | | | | | | |
| | 1,6-hexanediol | | | | | 0.30 | | |
| | 1,9-nonanediol | 0.53 | 0.52 | 0.52 | | | | |
| | 1,12-dodecanediol | | | | 0.52 | | 0.20 | |
| | 1,16-hexadecanediol | | | | | | | 0.50 |
| | Bisphenol A-propylene oxide 2 mole adduct | | | | | 0.20 | 0.30 | |
| Carboxylic acid component (molar ratio) | Adipic acid | | | | 0.20 | | | 0.35 |
| | Sebacic acid | 0.47 | 0.45 | 0.45 | | | | 0.15 |
| | 1,12-dodecane dicarboxylic acic | | | | | 0.50 | 0.20 | |
| | 1,14-tetradecane dicarboxylic acic | | | | | | | |
| | 1,18-octadecane dicarboxylic acic | | | | | | | |
| | Terephthalic acid | | | | 0.28 | | 0.30 | |
| Reactive carboxylic acid | Acrylic acid | | 0.03 | 0.03 | | | | |
| | Styrene denaturation | — | 5% | 15% | — | — | — | — |
| Physical properties | Molecular weight | 16100 | 17800 | 19300 | 15800 | 17100 | 15700 | 13700 |
| | Hydroxyl value | 3.5 | 0.7 | 0.6 | 3.3 | 2.9 | 2.8 | 3.1 |
| | Acid value | 2.8 | 2.0 | 2.1 | 3.0 | 2.8 | 2.9 | 4.2 |
| | Melting point | 78.9 | 76.1 | 70.3 | 61.2 | 60.7 | 62.8 | 78.8 |

| | | Polyester resin no. | | | | | | |
|---|---|---|---|---|---|---|---|---|
| | | (8) | (9) | (10) | (11) | (12) | (13) | (14) |
| Alcohol component (molar ratio) | 1,4-butanediol | 0.50 | 0.50 | 0.45 | 0.40 | 0.30 | | |
| | 1,6-hexanediol | | | 0.05 | 0.10 | 0.20 | | |
| | 1,9-nonanediol | | | | | | 0.50 | 0.40 |
| | 1,12-dodecanediol | | | | | | | 0.10 |
| | 1,16-hexadecanediol | | | | | | | |
| | Bisphenol A-propylene oxide 2 mole adduct | | | | | | | |
| Carboxylic acid component (molar ratio) | Adipic acid | | | 0.45 | 0.45 | 0.45 | | |
| | Sebacic acid | | | 0.05 | 0.05 | 0.05 | | |
| | 1,12-dodecane dicarboxylic acic | | | | | | 0.17 | |
| | 1,14-tetradecane dicarboxylic acic | 0.50 | 0.20 | | | | 0.33 | 0.50 |
| | 1,18-octadecane dicarboxylic acic | | 0.30 | | | | | |
| | Terephthalic acid | | | | | | | |
| Reactive carboxylic acid | Acrylic acid | | | | | | | |
| | Styrene denaturation | — | — | | — | — | — | — |
| Physical properties | Molecular weight | 10400 | 10400 | 24500 | 21200 | 26800 | 13600 | 14100 |
| | Hydroxyl value | 5.1 | 5.3 | 2.0 | 3.4 | 1.8 | 3.3 | 3.2 |
| | Acid value | 4.1 | 3.9 | 2.1 | 2.8 | 2.1 | 3.2 | 3.0 |
| | Melting point | 73.5 | 78.1 | 43.8 | 46.4 | 53.4 | 87.9 | 93.2 |

Production Example of Aromatic Polyester Resin (1)

Terephthalic acid: 7.0 mol

Isophthalic acid: 4.0 mol

Bisphenol A-propylene oxide 2 mole adduct (PO-BPA): 10.9 mol

The above-mentioned monomers were charged into an autoclave together with an esterification catalyst, a pressure reducing device, water separating device, nitrogen gas introduction device, temperature measuring device and stirring device were attached to the autoclave, and a reaction was carried in accordance with ordinary methods at 210° C. in a nitrogen atmosphere under reduced pressure until TG reached 63° C. 0.3 mol of trimellitic anhydride were added thereto and reacted for 1 hour to obtain aromatic polyester resin (1). The weight-average molecular weight (Mw) of aromatic polyester resin (1) was 8,200, Tg was 69.1° C. and the acid value was 10.6 mgKOH/g.

Production Example of Styrene-Based Vinyl Resin (1)

Styrene (St): 91.70 parts by mass

Methyl methacrylate (MMA): 2.50 parts by mass

Methacrylic acid (MAA): 3.30 parts by mass 2-hydroxyethyl methacrylate (2HEMA): 2.50 parts by mass Perbutyl-D (10 hour half-life temperature: 54.6° C., NOF Corp.): 2.00 parts by mass Each of the above-mentioned components was placed in a four-mouth flask and after adequately replacing the inside of the flask with nitrogen and raising the temperature to 150° C. while stirring, 200 parts by mass of xylene were dropped in over the course of 2 hours. Moreover, polymerization was terminated after holding for 10 hours while refluxing with xylene followed by distilling off the solvent under reduced pressure to obtain styrene-based vinyl resin (1). The weight-average molecular weight (Mw) of styrene-based vinyl resin (1) was 14,800, Tg was 91.8° C., the acid value was 10.3 mgKOH/g and the hydroxyl value was 20.3 mgKOH/g.

Production Example of Charge Control Resin 1

250 parts by mass of methanol, 150 parts by mass of 2-butanol and 100 parts by mass of 2-propanol as solvent, and 88 parts by mass of styrene, 6.0 parts by mass of 2-ethylhexyl acrylate and 6.0 parts by mass of 2-acrylamide-2-methylpropanesulfonate as monomers were added to a reaction vessel equipped with a reflux condenser, stirrer, thermometer, nitrogen inlet tube, dropping device and pressure reducing device followed by stirring and heating while refluxing at normal pressure. A solution obtained by diluting 1.0 parts by mass of a polymerization initiator in the form of 2,2'-azobisisobutyronitrile with 20 parts by mass of 2-butanone was dropped in over the course of 30 minutes followed by continuing to stir for 5 hours. Moreover, a solution obtained by diluting 1.0 part by mass of 2,2'-azobisisobutyronitrile with 20 parts by mass of 2-butanone was dropped in over the course of 30 minutes followed by stirring for 5 hours while refluxing at normal pressure to complete polymerization.

Next, after distilling off the polymerization solvent under reduced pressure, the resulting polymer was coarsely pulverized to 100 μm or smaller with a cutter mill equipped with a 150 mesh screen and then finely pulverized with a jet mill. The fine particles were then classified with a 250 mesh sieve to separate and obtain particles of 60 μm or less. Next, the above-mentioned particles were dissolved by addition of methyl ethyl ketone to a concentration of 10%, and the resulting solution was re-precipitated by gradually adding to methanol at 20 times the amount of methyl ethyl ketone. The resulting precipitate was washed with one-half the amount of methanol used for re-precipitation, and the filtered particles were vacuum-dried at 35° C. for 48 hours.

Moreover, the above-mentioned vacuum-dried particles were re-dissolved by addition of methyl ethyl ketone to a concentration of 10%, and the resulting solution was re-precipitated by gradually adding to n-hexane at 20 times the amount of methyl ethyl ketone. The resulting precipitate was washed with one-half the amount of n-hexane used for re-precipitation, and the filtered particles were vacuum-dried for 48 hours at 35° C. The charge control resin obtained in this manner had a Tg of about 82° C., main peak molecular weight (Mp) of 21,500, number-average molecular weight (Mn) of 13,700, weight-average molecular weight (Mw) of 22,800 and acid value of 18.4 mgKOH/g. The resulting resin was designated as charge control resin 1.

Production Example of Toner Particle 1

700 parts by mass of ion exchange water, 1,000 parts by mass of 0.1 mol/L aqueous $Na_3PO_4$ solution and 24.0 parts by mass of 1.0 mol/L aqueous HCL solution were added to a four-mouth vessel equipped with a reflux condenser, stirrer, thermometer and nitrogen inlet tube followed by holding at 60° C. while stirring at 12,000 rpm using a high-speed stirring device in the form of a TK Homomixer. 85 parts by mass of 1.0 mol/L aqueous $CaCl_2$ solution were then gradually added thereto to prepare an aqueous dispersion medium containing a fine, poorly soluble dispersion stabilizer in the form of $Ca_3(PO_4)_2$.

Styrene: 62.4 parts by mass
n-butylacrylate: 17.6 parts by mass
Divinylbenzene: 0.05 parts by mass
Vinyltriethoxysilane: 5.0 parts by mass
Copper phthalocyanine pigment: 7.0 parts by mass (Pigment Blue 15:3) (P.B. 15:3)
Polyester resin (3): 4.0 parts by mass
Toluene: 80.0 parts by mass
Aromatic polyester (1): 2.0 parts by mass
Styrene-based vinyl resin (1): 5.0 parts by mass
Charge control agent: 0.5 parts by mass Aluminum compound of 3,5-di-tert-butylsalicylic acid Charge control resin 1: 0.5 parts by mass
Release agent: 10.0 parts by mass (behenyl behenate, melting point: 72.1° C.)

A polymerizable monomer composition 1, obtained by dispersing the above-mentioned materials for 3 hours with an attritor, was held for 20 minutes at 60° C. Subsequently, polymerizable monomer composition 1, obtained by further adding 13.0 parts by mass of a polymerization initiator in the form of t-butylperoxypivalate (50% toluene solution) to polymerizable monomer composition 1, was charged into an aqueous medium followed by granulating for 10 minutes while maintaining the rotating speed of a high-speed stirring device at 12,000 rpm. Subsequently, the high-speed stirring device was replaced with a propeller-type stirrer and the internal temperature was raised to 70° C. followed by allowing to react for 5 hours while stirring slowly. At this time, the pH of the aqueous medium was 5.1. Next, 1.0 mol/L aqueous sodium hydroxide solution was added to adjust the pH to 10.2 followed by raising the temperature inside the vessel to 85.0° C. and holding at that temperature for 5 hours. Subsequently, a mixed solution of 100 parts by mass of 10% hydrochloric acid and 500 parts of ion exchange water were added to adjust the pH to 5.1. Next, 300 parts by mass of ion exchange water were added, the reflux condenser was removed and a distillation device was attached. Distillation was carried out for 3 hours at a temperature inside the vessel of 100° C. to distill off the toluene and obtain polymer slurry 1. The amount of the distilled fraction was 350 parts by mass. After cooling to 30° C., dilute hydrochloric acid was added to the vessel containing the polymer slurry 1 followed by removal of the dispersion stabilizer. Moreover, toner particles having a weight-average particle diameter of 5.6 μm were obtained by further filtering, washing and drying. The toner particles were designated as toner particle 1. Surface layer of the resulting toner particle 1 was confirmed to not be a coat layer formed by adhesion of particulate clumps containing silicon compounds. The formulation and conditions of toner particle 1 are shown in Table 2 and the physical properties are shown in Table 6.

Production Examples of Toner Particles 2 to 29

Toner particles 2 to 29 were obtained in the same manner as the production example of toner particle 1 with the exception of changing the raw materials used to those shown in Tables 2 to 4. Furthermore, toluene was distilled off by vacuum distillation with respect to those toner particles for which the temperature during distillation was 60° C. Surface layers of the resulting toner particles 2 to 29 were confirmed to not be a coat layer formed by adhesion of particulate clumps containing silicon compounds. The formulation and conditions of toner particles 2 to 29 are shown in Tables 2 to 4 and the physical properties are shown in Tables 6 to 8.

Production Examples of Comparative Toner Particles 1 to 8

Comparative toner particles 1 to 8 were obtained in the same manner as the production example of toner particle 1 with the exception of changing the raw materials used to those shown in Table 5. Furthermore, toluene was distilled off by vacuum distillation with respect to those toner particles for which the temperature during distillation was 60° C. The formulation and conditions of comparative toner particles 1 to 8 are shown in Table 5 and the physical properties are shown in Table 9.

Production Example of Comparative Toner Particle 9

Production Method of Organic Silicon-Containing Binder Resin A

Vinyltriethoxysilane: 100 parts by mass
Styrene: 360 parts by mass
n-butylacrylate: 40 parts by mass
Toluene: 360 parts by mass The above-mentioned raw materials were charged into a four-mouth vessel equipped with a reflux condenser, stirrer, thermometer and nitrogen inlet tube and heated to 70° C. Subsequently, 30.0 parts by mass of a polymerization initiator in the form of t-butylperoxypivalate (50% toluene solution) were added and the reaction was allowed to proceed for 10 hours while holding at 70° C. Next, the resulting reaction product was transferred to a vacuum distillation device and solvent and unreacted monomer were distilled off at 70° C.

On the other hand, 1,000 parts by mass of 0.05 mol/L aqueous sodium hydroxide solution were charged into a four-mouth vessel equipped with a reflux condenser, stirrer, thermometer and nitrogen inlet tube and heated to 60° C. The above-mentioned reaction product was gradually dropped therein and a reaction was allowed to proceed for 10 hours after raising the temperature to 85° C. This was then cooled to 30° C. followed by filtering, washing and drying to obtain organic silicon-containing binder resin A.

Production Method of Toner Binder Resin B

Toluene: 300 parts by mass
Styrene: 200 parts by mass
n-butylacrylate: 30 parts by mass
Methacrylic acid: 25 parts by mass
Sodium styrene sulfonate: 15 parts by mass The above-mentioned raw materials were placed in a reaction vessel equipped with a stirrer, condenser, thermometer and nitrogen inlet tube and dissolved in 25 parts by mass of a 70% toluene solution of 1,1,3,3-tetramethylbutylperoxy-2-ethylhexanoate. Next, 0.10 parts by mass of trimethylolpropane tris(3-mercaptopropionate) (β-mercaptopropionate, Sakai Chemical Industry Co., Ltd.) were added and the temperature was raised to 80° C. in a nitrogen atmosphere followed by polymerizing for 4 hours. Subsequently, after removing the solvent under reduced pressure, the reaction product was coarsely pulverized to a size of 2 mm or less with a hammer mill to obtain toner binder resin B.

Organic silicon-containing resin binder A: 25.0 parts by mass
Toner binder resin B: 65.0 parts by mass
Polyester resin (3): 10.0 parts by mass
Copper phthalocyanine pigment: 7.0 parts by mass (Pigment Blue 15:3) (P.B. 15:3)
Charge control agent: 1.0 part by mass (Aluminum compound of 3,5-di-tert-butylsalicylic acid)
Charge control resin 1: 1.0 part by mass
Release agent: 10.0 parts by mass (behenyl behenate, melting point: 72.1° C.)

The materials formulated in the manner indicated above were mixed well with a HENSCHEL® mixer followed by kneading with a twin-screw kneader set to a temperature of 130° C. The resulting kneaded product was cooled and coarsely crushed to a size of 2 mm or less with a hammer mill to obtain a coarsely pulverized product.

The resulting coarsely pulverized product was intermediately pulverized to a weight-average particle diameter of 100 μm using the ACM10 manufactured by Hosokawa Micron Ltd., and the resulting intermediately pulverized product was finely pulverized using a mechanical pulverizer 301 (TURBO MILL® Model T250-RS pulverizer, Freund-Turbo Corp.). Subsequently, the resulting finely pulverized product was coarsely classified using the 100ATP TURBOPLEX® classifier manufactured by Hosokawa Micron Ltd. and further classified using a pneumatic classifier to obtain toner particles having a weight-average particle diameter of 6.1 μm. These toner particles were designated as comparative toner particle 9. The physical properties of comparative toner particle 9 are shown in Table 9.

TABLE 2

| | | | | Toner particle | | | | |
|---|---|---|---|---|---|---|---|---|
| | | | | 1 | 2 | 3 | 4 | 5 |
| Binder resin component | Monomer | Styrene | mass parts | 62.4 | 62.4 | 62.4 | 60.0 | 60.0 |
| | | n-butyl acrylate | mass parts | 17.6 | 17.6 | 17.6 | 20.0 | 16.0 |
| | | n-butyl methacrylate | mass parts | 0.0 | 0.0 | 0.0 | 0.0 | 4.0 |
| | | n-behenyl acrylate | mass parts | 0.0 | 0.0 | 0.0 | 0.0 | 0.0 |
| | | Acrylate | mass parts | 0.0 | 0.0 | 0.0 | 0.0 | 0.0 |
| | | Divinyl benzene | mass parts | 0.05 | 0.05 | 0.05 | 0.05 | 0.05 |

TABLE 2-continued

| | | | | | | | | |
|---|---|---|---|---|---|---|---|---|
| | | Silane 1 | Silane type | Vinyl triethoxy silane | Vinyl triethoxy silane | Vinyl triethoxy silane | Vinyl triethoxy silane | Vinyl triethoxy silane |
| | | | mass parts | 5.0 | 5.0 | 5.0 | 5.0 | 5.0 |
| | | Silane 2 | Silane type | | | | | |
| | | | mass parts | | | | | |
| | Polymer | Polyester resin | Polyester type | (3) | (3) | (3) | (1) | (1) |
| | | | mass parts | 20.0 | 20.0 | 20.0 | 20.0 | 20.0 |
| Additive | | Aromatic polyester resin (1) | mass parts | 2.0 | 2.0 | 0.0 | 0.0 | 0.0 |
| | | Styrene-based vinyl resin (1) | mass parts | 5.0 | 0.0 | 5.0 | 0.0 | 0.0 |
| | | Release agent | Type | Behenyl behenate | Behenyl behenate | Behenyl behenate | Behenyl behenate | Behenyl behenate |
| | | | mass parts | 10.0 | 10.0 | 10.0 | 10.0 | 10.0 |
| | | | Melting point (° C.) | 72.1 | 72.1 | 72.1 | 72.1 | 72.1 |
| | | | endothermic quantity (J/g) | 210.3 | 210.3 | 210.3 | 210.3 | 210.3 |
| | | Colorant | Type | P.B. 15:3 | P.B. 15:3 | P.B. 15:3 | P.B. 15:3 | P.B. 15:3 |
| | | | mass parts | 7.0 | 7.0 | 7.0 | 7.0 | 7.0 |
| | | Charge control resin | mass parts | 0.5 | 0.5 | 0.5 | 0.5 | 0.5 |
| | | Charge control agent | mass parts | 0.5 | 0.5 | 0.5 | 0.5 | 0.5 |
| Initiator | | Liposoluble initiator | mass parts | 13.0 | 13.0 | 13.0 | 13.0 | 13.0 |
| Polymerization conditions | | Reaction 1 | Temp. | 70.0 | 70.0 | 70.0 | 70.0 | 70.0 |
| | | | Holding time | 5.0 | 5.0 | 5.0 | 5.0 | 5.0 |
| | | | pH | 5.1 | 5.1 | 5.1 | 5.1 | 5.1 |
| | | Reaction 2 | Temp. | 85.0 | 85.0 | 85.0 | 85.0 | 85.0 |
| | | | Holding time | 5.0 | 5.0 | 5.0 | 5.0 | 5.0 |
| | | | pH | 10.2 | 10.2 | 10.2 | 10.2 | 10.2 |
| | | Reaction 3 | Temp. | 100.0 | 100.0 | 100.0 | 100.0 | 100.0 |
| | | | Holding time | 3.0 | 3.0 | 3.0 | 3.0 | 3.0 |
| | | | pH | 5.1 | 5.1 | 5.1 | 5.1 | 5.1 |

| | | | | Toner particle | | | | |
|---|---|---|---|---|---|---|---|---|
| | | | | 6 | 7 | 8 | 9 | 10 |
| Binder resin component | Monomer | Styrene | mass parts | 60.0 | 60.0 | 68.4 | 68.4 | 68.4 |
| | | n-butyl acrylate | mass parts | 16.0 | 16.0 | 26.6 | 26.6 | 26.6 |
| | | n-butyl methacrylate | mass parts | 0.0 | 0.0 | 0.0 | 0.0 | 0.0 |
| | | n-behenyl acrylate | mass parts | 4.0 | 0.0 | 0.0 | 0.0 | 0.0 |
| | | Acrylate | mass parts | 0.0 | 4.0 | 0.0 | 0.0 | 0.0 |
| | | Divinyl benzene | mass parts | 0.05 | 0.05 | 0.05 | 0.05 | 0.05 |
| | | Silane 1 | Silane type | Vinyl triethoxy silane | Vinyl triethoxy silane | Vinyl triethoxy silane | Vinyl triethoxy silane | Vinyl triethoxy silane |
| | | | mass parts | 5.0 | 5.0 | 5.0 | 5.0 | 5.0 |
| | | Silane 2 | Silane type | | | | | |
| | | | mass parts | | | | | |
| | Polymer | Polyester resin | Polyester type | (1) | (1) | (4) | (5) | (5) |
| | | | mass parts | 20.0 | 20.0 | 5.0 | 5.0 | 5.0 |

TABLE 2-continued

| | | | | | | | |
|---|---|---|---|---|---|---|---|
| Additive | Aromatic polyester resin (1) | mass parts | 0.0 | 0.0 | 0.0 | 0.0 | 0.0 |
| | Styrene-based vinyl resin (1) | mass parts | 0.0 | 0.0 | 0.0 | 0.0 | 0.0 |
| | Release agent | Type | Behenyl behenate | Behenyl behenate | Behenyl behenate | Behenyl behenate | Behenyl behenate |
| | | mass parts | 10.0 | 10.0 | 10.0 | 10.0 | 10.0 |
| | | Melting point (° C.) | 72.1 | 72.1 | 72.1 | 72.1 | 72.1 |
| | | endothermic quantity (J/g) | 210.3 | 210.3 | 210.3 | 210.3 | 210.3 |
| | Colorant | Type | P.B. 15:3 | P.B. 15:3 | P.B. 15:3 | P.B. 15:3 | P.B. 15:3 |
| | | mass parts | 7.0 | 7.0 | 7.0 | 7.0 | 7.0 |
| | Charge control resin | mass parts | 0.5 | 0.5 | 0.5 | 0.5 | 0.5 |
| | Charge control agent | mass parts | 0.5 | 0.5 | 0.5 | 0.5 | 0.5 |
| Initiator | Liposoluble initiator | mass parts | 13.0 | 13.0 | 15.0 | 15.0 | 15.0 |
| Polymerization conditions | Reaction 1 | Temp. | 70.0 | 70.0 | 70.0 | 70.0 | 70.0 |
| | | Holding time | 5.0 | 5.0 | 5.0 | 5.0 | 5.0 |
| | | pH | 5.1 | 5.1 | 5.1 | 5.1 | 5.1 |
| | Reaction 2 | Temp. | 85.0 | 85.0 | 85.0 | 70.0 | 70.0 |
| | | Holding time | 5.0 | 5.0 | 5.0 | 5.0 | 5.0 |
| | | pH | 10.2 | 10.2 | 8.0 | 8.0 | 8.0 |
| | Reaction 3 | Temp. | 100.0 | 100.0 | 100.0 | 100.0 | 100.0 |
| | | Holding time | 3.0 | 3.0 | 3.0 | 3.0 | 3.0 |
| | | pH | 5.1 | 5.1 | 5.1 | 5.1 | 5.1 |

TABLE 3

| | | | | Toner particle | | | | |
|---|---|---|---|---|---|---|---|---|
| | | | | 11 | 12 | 13 | 14 | 15 |
| Binder resin component | Monomer | Styrene | mass parts | 68.4 | 68.4 | 68.4 | 68.4 | 67.5 |
| | | n-butyl acrylate | mass parts | 26.6 | 26.6 | 26.6 | 26.6 | 22.5 |
| | | n-butyl methacrylate | mass parts | 0.0 | 0.0 | 0.0 | 0.0 | 0.0 |
| | | n-behenyl acrylate | mass parts | 0.0 | 0.0 | 0.0 | 0.0 | 0.0 |
| | | Acrylate | mass parts | 0.0 | 0.0 | 0.0 | 0.0 | 0.0 |
| | | Divinyl benzene | mass parts | 0.05 | 0.05 | 0.05 | 0.05 | 0.05 |
| | | Silane 1 | Silane type | Vinyl triethoxy silane | Vinyl triethoxy silane | Vinyl triethoxy silane | Vinyl triethoxy silane | Vinyl triethoxy silane |
| | | | mass parts | 3.0 | 2.0 | 1.0 | 0.5 | 5.0 |
| | | Silane 2 | Silane type | | | | | |
| | | | mass parts | | | | | |
| | Polymer | Polyester resin | Polyester type | (2) | (2) | (2) | (2) | (14) |
| | | | mass parts | 5.0 | 5.0 | 5.0 | 5.0 | 10.0 |
| Additive | | Aromatic polyester resin (1) | mass parts | 0.0 | 0.0 | 0.0 | 0.0 | 0.0 |
| | | Styrene-based vinyl resin (1) | mass parts | 0.0 | 0.0 | 0.0 | 0.0 | 5.0 |

TABLE 3-continued

| | | | | | | | | |
|---|---|---|---|---|---|---|---|---|
| | | Release agent | Type | Behenyl behenate | Behenyl behenate | Behenyl behenate | Behenyl behenate | Behenyl behenate |
| | | | mass parts | 10.0 | 10.0 | 10.0 | 10.0 | 10.0 |
| | | | Melting point (° C.) | 72.1 | 72.1 | 72.1 | 72.1 | 72.1 |
| | | | endothermic quantity (J/g) | 210.0 | 210.3 | 210.3 | 210.3 | 210.3 |
| | | Colorant | Type | P.B. 15:3 | P.B. 15:3 | P.B. 15:3 | P.B. 15:3 | P.B. 15:3 |
| | | | mass parts | 7.0 | 7.0 | 7.0 | 7.0 | 7.0 |
| | | Charge control resin | mass parts | 0.5 | 0.5 | 0.5 | 0.5 | 0.5 |
| | | Charge control agent | mass parts | 0.5 | 0.5 | 0.5 | 0.5 | 0.5 |
| Initiator | | Liposoluble initiator | mass parts | 15.0 | 15.0 | 15.0 | 15.0 | 14.0 |
| Polymerization conditions | | Reaction 1 | Temp. | 70.0 | 70.0 | 70.0 | 70.0 | 70.0 |
| | | | Holding time | 5.0 | 5.0 | 5.0 | 5.0 | 5.0 |
| | | | pH | 5.1 | 5.1 | 5.1 | 5.1 | 5.1 |
| | | Reaction 2 | Temp. | 70.0 | 70.0 | 70.0 | 70.0 | 85.0 |
| | | | Holding time | 5.0 | 5.0 | 5.0 | 5.0 | 5.0 |
| | | | pH | 8.0 | 8.0 | 8.0 | 8.0 | 10.2 |
| | | Reaction 3 | Temp. | 100.0 | 100.0 | 100.0 | 100.0 | 100.0 |
| | | | Holding time | 3.0 | 3.0 | 3.0 | 3.0 | 3.0 |
| | | | pH | 5.1 | 5.1 | 5.1 | 5.1 | 5.1 |

| | | | | Toner particle | | | | |
|---|---|---|---|---|---|---|---|---|
| | | | | 16 | 17 | 18 | 19 | 20 |
| Binder resin component | Monomer | Styrene | mass parts | 67.5 | 67.5 | 67.5 | 67.5 | 22.5 |
| | | n-butyl acrylate | mass parts | 22.5 | 22.5 | 22.5 | 22.5 | 2.5 |
| | | n-butyl methacrylate | mass parts | 0.0 | 0.0 | 0.0 | 0.0 | 0.0 |
| | | n-behenyl acrylate | mass parts | 0.0 | 0.0 | 0.0 | 0.0 | 0.0 |
| | | Acrylate | mass parts | 0.0 | 0.0 | 0.0 | 0.0 | 0.0 |
| | | Divinyl benzene | mass parts | 0.05 | 0.05 | 0.05 | 0.01 | 0.05 |
| | | Silane 1 | Silane type | Vinyl triethoxy silane | Vinyl triethoxy silane | Vinyl triethoxy silane | Vinyl triethoxy silane | Vinyl triethoxy silane |
| | | | mass parts | 5.0 | 7.0 | 7.0 | 7.0 | 15.0 |
| | | Silane 2 | Silane type | | | | | |
| | | | mass parts | | | | | |
| | Polymer | Polyester resin | Polyester type | (13) | (12) | (11) | (10) | (7) |
| | | | mass parts | 10.0 | 10.0 | 10.0 | 10.0 | 75.0 |
| Additive | | Aromatic polyester resin (1) | mass parts | 0.0 | 0.0 | 0.0 | 0.0 | 3.0 |
| | | Styrene-based vinyl resin (1) | mass parts | 5.0 | 5.0 | 5.0 | 5.0 | 5.0 |
| | | Release agent | Type | Behenyl behenate | Behenyl behenate | Behenyl behenate | Behenyl behenate | Behenyl behenate |
| | | | mass parts | 10.0 | 10.0 | 10.0 | 10.0 | 10.0 |
| | | | Melting point (° C.) | 72.1 | 72.1 | 72.1 | 72.1 | 72.1 |
| | | | endothermic quantity (J/g) | 210.3 | 210.3 | 210.3 | 210.3 | 210.3 |
| | | Colorant | Type | P.B. 15:3 | P.B. 15:3 | P.B. 15:3 | P.B. 15:3 | P.B. 15:3 |
| | | | mass parts | 7.0 | 7.0 | 7.0 | 7.0 | 7.0 |

TABLE 3-continued

| | | | | | | | |
|---|---|---|---|---|---|---|---|
| | Charge control resin | mass parts | 0.5 | 0.5 | 0.5 | 0.5 | 0.5 |
| | Charge control agent | mass parts | 0.5 | 0.5 | 0.5 | 0.5 | 0.5 |
| Initiator | Liposoluble initiator | mass parts | 14.0 | 14.0 | 14.0 | 14.0 | 5.0 |
| Polymerization conditions | Reaction 1 | Temp. | 70.0 | 70.0 | 70.0 | 70.0 | 70.0 |
| | | Holding time | 5.0 | 5.0 | 5.0 | 5.0 | 5.0 |
| | | pH | 5.1 | 5.1 | 5.1 | 5.1 | 5.1 |
| | Reaction 2 | Temp. | 85.0 | 85.0 | 85.0 | 85.0 | 85.0 |
| | | Holding time | 5.0 | 5.0 | 5.0 | 5.0 | 5.0 |
| | | pH | 10.2 | 10.2 | 10.2 | 10.2 | 10.2 |
| | Reaction 3 | Temp. | 100.0 | 100.0 | 100.0 | 100.0 | 100.0 |
| | | Holding time | 3.0 | 3.0 | 3.0 | 3.0 | 3.0 |
| | | pH | 5.1 | 5.1 | 5.1 | 5.1 | 5.1 |

TABLE 4

| | | | | Toner particle | | | | |
|---|---|---|---|---|---|---|---|---|
| | | | | 21 | 22 | 23 | 24 | 25 |
| Binder resin component | Monomer | Styrene | mass parts | 42.5 | 42.5 | 67.6 | 64.3 | 57.6 |
| | | n-butyl acrylate | mass parts | 7.5 | 7.5 | 29.0 | 27.6 | 22.4 |
| | | n-butyl methacrylate | mass parts | 0.0 | 0.0 | 0.0 | 0.0 | 0.0 |
| | | n-behenyl acrylate | mass parts | 0.0 | 0.0 | 0.0 | 0.0 | 0.0 |
| | | Acrylate | mass parts | 0.0 | 0.0 | 0.0 | 4.8 | 0.0 |
| | | Divinyl benzene | mass parts | 0.05 | 0.05 | 0.05 | 0.05 | 0.05 |
| | | Silane 1 | Silane type | Vinyl triethoxy silane | Vinyl triethoxy silane | Vinyl triethoxy silane | Vinyl triethoxy silane | Vinyl triethoxy silane |
| | | | mass parts | 15.0 | 15.0 | 10.0 | 5.0 | 10.0 |
| | | Silane 2 | Silane type | | | | Dimethyl diethoxy silane | |
| | | | mass parts | | | | 5.0 | |
| | Polymer | Polyester resin | Polyester type | (7) | (8) | (2) | (2) | (2) |
| | | | mass parts | 50.0 | 50.0 | 3.5 | 3.5 | 20.0 |
| Additive | | Aromatic polyester resin (1) | mass parts | 3.0 | 3.0 | 3.0 | 3.0 | 0.0 |
| | | Styrene-based vinyl resin (1) | mass parts | 5.0 | 5.0 | 5.0 | 5.0 | 0.0 |
| | | Release agent | Type | Behenyl behenate | Behenyl behenate | Behenyl behenate | Behenyl behenate | Behenyl behenate |
| | | | mass parts | 10.0 | 10.0 | 10.0 | 10.0 | 10.0 |
| | | | Melting point (° C.) | 72.1 | 72.1 | 72.1 | 72.1 | 72.1 |
| | | | endothermic quantity (J/g) | 210.0 | 210.3 | 210.3 | 210.3 | 210.3 |
| | | Colorant | Type | P.B. 15:3 | P.B. 15:3 | P.B. 15:3 | P.B. 15:3 | P.B. 15:3 |
| | | | mass parts | 7.0 | 7.0 | 7.0 | 7.0 | 7.0 |
| | | Charge control resin | mass parts | 0.5 | 0.5 | 0.5 | 0.5 | 0.5 |
| | | Charge control agent | mass parts | 0.5 | 0.5 | 0.5 | 0.5 | 0.5 |
| Initiator | | Liposoluble initiator | mass parts | 8.0 | 8.0 | 16.0 | 16.0 | 13.0 |

TABLE 4-continued

| | | | | | | | |
|---|---|---|---|---|---|---|---|
| Polymerization conditions | Reaction 1 | Temp. | 70.0 | 70.0 | 60.0 | 60.0 | 70.0 |
| | | Holding time | 5.0 | 5.0 | 5.0 | 5.0 | 5.0 |
| | | pH | 5.1 | 5.1 | 5.1 | 5.1 | 5.1 |
| | Reaction 2 | Temp. | 85.0 | 85.0 | 60.0 | 60.0 | 85.0 |
| | | Holding time | 5.0 | 5.0 | 10.0 | 10.0 | 5.0 |
| | | pH | 10.2 | 10.2 | 5.1 | 5.1 | 10.2 |
| | Reaction 3 | Temp. | 100.0 | 100.0 | 60.0 | 60.0 | 100.0 |
| | | Holding time | 3.0 | 3.0 | 3.0 | 3.0 | 3.0 |
| | | pH | 5.1 | 5.1 | 5.1 | 5.1 | 5.1 |

| | | | | Toner particle | | | |
|---|---|---|---|---|---|---|---|
| | | | | 26 | 27 | 28 | 29 |
| Binder resin component | Monomer | Styrene | mass parts | 57.6 | 57.6 | 57.6 | 57.6 |
| | | n-butyl acrylate | mass parts | 22.4 | 22.4 | 22.4 | 22.4 |
| | | n-butyl methacrylate | mass parts | 0.0 | 0.0 | 0.0 | 0.0 |
| | | n-behenyl acrylate | mass parts | 0.0 | 0.0 | 0.0 | 0.0 |
| | | Acrylate | mass parts | 0.0 | 0.0 | 0.0 | 0.0 |
| | | Divinyl benzene | mass parts | 0.05 | 0.05 | 0.05 | 0.05 |
| | | Silane 1 | Silane type | Vinyl triethoxy silane | Vinyl triethoxy silane | Vinyl triethoxy silane | Vinyl triethoxy silane |
| | | | mass parts | 10.0 | 5.0 | 5.0 | 5.0 |
| | | Silane 2 | Silane type | | | | |
| | | | mass parts | | | | |
| | Polymer | Polyester resin | Polyester type | (2) | (3) | (3) | (3) |
| | | | mass parts | 20.0 | 20.0 | 20.0 | 20.0 |
| Additive | | Aromatic polyester resin (1) | mass parts | 0.0 | 2.0 | 2.0 | 2.0 |
| | | Styrene-based vinyl resin (1) | mass parts | 0.0 | 5.0 | 5.0 | 5.0 |
| | | Release agent | Type | Behenyl behenate | Behenyl behenate | Behenyl behenate | Behenyl behenate |
| | | | mass parts | 10.0 | 10.0 | 10.0 | 10.0 |
| | | | Melting point (° C.) | 72.1 | 72.1 | 72.1 | 72.1 |
| | | | endothermic quantity (J/g) | 210.3 | 210.3 | 210.3 | 210.3 |
| | | Colorant | Type | P.B. 15:3 | Carbon black | P.R. 122 | P.Y. 155 |
| | | | mass parts | 7.0 | 10.0 | 8.0 | 7.0 |
| | | Charge control resin | mass parts | 0.5 | 0.5 | 0.5 | 0.5 |
| | | Charge control agent | mass parts | 0.5 | 0.5 | 0.5 | 0.5 |
| Initiator | | Liposoluble initiator | mass parts | 13.0 | 13.0 | 13.0 | 13.0 |
| Polymerization conditions | | Reaction 1 | Temp. | 70.0 | 70.0 | 70.0 | 70.0 |
| | | | Holding time | 5.0 | 5.0 | 5.0 | 5.0 |
| | | | pH | 5.1 | 5.1 | 5.1 | 5.1 |
| | | Reaction 2 | Temp. | 85.0 | 85.0 | 85.0 | 85.0 |
| | | | Holding time | 5.0 | 5.0 | 5.0 | 5.0 |
| | | | pH | 10.2 | 10.2 | 10.2 | 10.2 |
| | | Reaction 3 | Temp. | 100.0 | 100.0 | 100.0 | 100.0 |
| | | | Holding time | 3.0 | 3.0 | 3.0 | 3.0 |
| | | | pH | 5.1 | 5.1 | 5.1 | 5.1 |

TABLE 5

| | | | | Comparative toner particle | | | | |
|---|---|---|---|---|---|---|---|---|
| | | | | 1 | 2 | 3 | 4 | 5 |
| Binder resin component | Monomer | Styrene | mass parts | 57.6 | 57.6 | 67.6 | 67.5 | 67.5 |
| | | n-butyl acrylate | mass parts | 22.4 | 22.4 | 29.0 | 22.5 | 22.5 |
| | | n-butyl methacrylate | mass parts | 0.0 | 0.0 | 0.0 | 0.0 | 0.0 |
| | | n-behenyl acrylate | mass parts | 0.0 | 0.0 | 0.0 | 0.0 | 0.0 |
| | | Acrylate | mass parts | 0.0 | 0.0 | 0.0 | 0.0 | 0.0 |
| | | Divinyl benzene | mass parts | 0.05 | 0.05 | 0.05 | 0.05 | 0.05 |
| | | Silane 1 | Silane type | Methacryloxy propyl triethoxy silane | Amino propyl triethoxy silane | Vinyl tributoxy silane | Vinyl triethoxy silane | Vinyl triethoxy silane |
| | | | mass parts | 10.0 | 10.0 | 10.0 | 5.0 | 5.0 |
| | | Silane 2 | Silane type | | | | | |
| | | | mass parts | | | | | |
| | Polymer | Polyester resin | Polyester type | (2) | (2) | (2) | (6) | (9) |
| | | | mass parts | 20.0 | 20.0 | 3.5 | 10.0 | 10.0 |
| Additive | | Aromatic polyester resin (1) | mass parts | 0.0 | 0.0 | 3.0 | 3.0 | 3.0 |
| | | Styrene-based vinyl resin (1) | mass parts | 0.0 | 0.0 | 5.0 | 5.0 | 5.0 |
| | | Release agent | Type | Behenyl behenate | Behenyl behenate | Behenyl behenate | Behenyl behenate | Behenyl behenate |
| | | | mass parts | 10.0 | 10.0 | 10.0 | 10.0 | 10.0 |
| | | | Melting point (° C.) | 72.1 | 72.1 | 72.1 | 72.1 | 72.0 |
| | | | endothermic quantity (J/g) | 210.3 | 210.3 | 210.3 | 210.3 | 210.0 |
| | | Colorant | Type | P.B. 15:3 | P.B. 15:3 | P.B. 15:3 | P.B. 15:3 | P.B. 15:3 |
| | | | mass | 7.0 | 7.0 | 7.0 | 7.0 | 7.0 |
| | | Charge control resin | mass parts | 0.5 | 0.5 | 0.5 | 0.5 | 0.5 |
| | | Charge control agent | mass parts | 0.5 | 0.5 | 0.5 | 0.5 | 0.5 |
| Initiator | | Liposoluble initiator | mass parts | 13.0 | 13.0 | 16.0 | 13.0 | 13.0 |
| Polymerization conditions | | Reaction 1 | Temp. | 70.0 | 70.0 | 60.0 | 70.0 | 70.0 |
| | | | Holding time | 5.0 | 5.0 | 5.0 | 5.0 | 5.0 |
| | | | pH | 5.1 | 5.1 | 5.1 | 5.1 | 5.1 |
| | | Reaction 2 | Temp. | 85.0 | 85.0 | 60.0 | 85.0 | 85.0 |
| | | | Holding time | 5.0 | 5.0 | 10.0 | 5.0 | 5.0 |
| | | | pH | 10.2 | 10.2 | 5.1 | 10.2 | 10.2 |
| | | Reaction 3 | Temp. | 100.0 | 100.0 | 60.0 | 100.0 | 100.0 |
| | | | Holding time | 3.0 | 3.0 | 3.0 | 3.0 | 3.0 |
| | | | pH | 5.1 | 5.1 | 5.1 | 5.1 | 5.1 |

| | | | | Comparative toner particle | | | |
|---|---|---|---|---|---|---|---|
| | | | | 6 | 7 | 8 | 9 |
| Binder resin component | Monomer | Styrene | mass parts | 63.1 | 14.3 | 56.0 | Described in description |
| | | n-butyl acrylate | mass parts | 34.0 | 0.8 | 14.0 | |
| | | n-butyl methacrylate | mass parts | 0.0 | 0.0 | 0.0 | |
| | | n-behenyl acrylate | mass parts | 0.0 | 0.0 | 0.0 | |
| | | Acrylate | mass parts | 0.0 | 0.0 | 0.0 | |

TABLE 5-continued

| | | | | | |
|---|---|---|---|---|---|
| | Divinyl benzene | mass parts | 0.05 | 0.05 | 0.05 |
| | Silane 1 | Silane type | Vinyl triethoxy silane | Vinyl triethoxy silane | |
| | | mass parts | 10.0 | 30.0 | |
| | Silane 2 | Silane type | | | |
| | | mass parts | | | |
| Polymer | Polyester resin | Polyester type | (2) | (7) | (3) |
| | | mass parts | 3.0 | 85.0 | 30.0 |
| Additive | Aromatic polyester resin (1) | mass parts | 3.0 | 3.0 | 3.0 |
| | Styrene-based vinyl resin (1) | mass parts | 5.0 | 5.0 | 5.0 |
| | Release agent | Type | Behenyl behenate | Behenyl behenate | Behenyl behenate |
| | | mass parts | 10.0 | 10.0 | 10.0 |
| | | Melting point (° C.) | 72.0 | 72.0 | 72.0 |
| | | endothermic quantity (J/g) | 210.0 | 210.0 | 210.0 |
| | Colorant | Type | P.B. 15:3 | P.B. 15:3 | P.B. 15:3 |
| | | mass parts | 7.0 | 7.0 | 7.0 |
| | Charge control resin | mass parts | 0.5 | 0.5 | 0.5 |
| | Charge control agent | mass parts | 0.5 | 0.5 | 0.5 |
| Initiator | Liposoluble initiator | mass parts | 16.0 | 4.5 | 4.5 |
| Polymerization conditions | Reaction 1 | Temp. | 60.0 | 70.0 | 70.0 |
| | | Holding time | 5.0 | 5.0 | 5.0 |
| | | pH | 5.1 | 5.1 | 5.1 |
| | Reaction 2 | Temp. | 60.0 | 85.0 | 85.0 |
| | | Holding time | 10.0 | 5.0 | 5.0 |
| | | pH | 5.1 | 10.2 | 10.2 |
| | Reaction 3 | Temp. | 60.0 | 100.0 | 100.0 |
| | | Holding time | 3.0 | 3.0 | 3.0 |
| | | pH | 5.1 | 5.1 | 5.1 |

TABLE 6

| | Toner particle | | | | | | | | | |
|---|---|---|---|---|---|---|---|---|---|---|
| | 1 | 2 | 3 | 4 | 5 | 6 | 7 | 8 | 9 | 10 |
| THF-insoluble matter (mass %) | 17.5 | 17.1 | 17.3 | 16.9 | 16.9 | 16.5 | 15.8 | 18.4 | 17.6 | 17.2 |
| Proportion of silicon atom in the organic silicon polymer having structure represented by —SiO3/2 | 63.0 | 61.0 | 61.0 | 62.0 | 59.3 | 60.1 | 57.3 | 49.3 | 40.5 | 41.9 |
| Silicon atom density of toner particle surface (atom %) | 12.3 | 12.4 | 12.6 | 12.3 | 11.8 | 13.4 | 10.8 | 8.3 | 6.5 | 7.3 |
| Average thickness Dav. of the surface layer (nm) | 22.3 | 23.5 | 21.5 | 22.0 | 20.3 | 20.9 | 23.5 | 19.8 | 16.3 | 17.3 |
| Proportion of surface layer having thickness of not more than 5.0 nm (%) | 4.4 | 4.1 | 5.3 | 3.1 | 3.1 | 6.3 | 3.1 | 4.4 | 12.5 | 14.3 |
| Weight-average particle diameter (μm) | 5.8 | 5.9 | 5.9 | 5.8 | 5.5 | 5.9 | 5.6 | 5.4 | 5.7 | 5.6 |

TABLE 6-continued

| | Toner particle | | | | | | | | | |
|---|---|---|---|---|---|---|---|---|---|---|
| | 1 | 2 | 3 | 4 | 5 | 6 | 7 | 8 | 9 | 10 |
| Number-average particle diameter (μm) | 4.9 | 5.0 | 5.0 | 4.9 | 4.7 | 5.0 | 4.8 | 4.6 | 4.9 | 4.7 |
| Endothermic main peak (° C.) | 70.2 | 70.3 | 70.3 | 70.0 | 70.2 | 70.0 | 70.0 | 70.3 | 70.3 | 70.2 |
| calorimetric integral value (J/g) | 19.4 | 19.3 | 19.4 | 19.3 | 19.2 | 19.2 | 19.2 | 19.3 | 19.2 | 19.5 |
| Glass transition temperature (° C.) | 48.2 | 48.2 | 49.1 | 46.5 | 47.3 | 43.8 | 49.3 | 45.4 | 46.3 | 46.1 |
| 80° C. viscosity (Pa · s) | 18500 | 19800 | 18100 | 17500 | 16900 | 17100 | 15800 | 22500 | 23100 | 22400 |

TABLE 7

| | Toner particle | | | | | | | | | |
|---|---|---|---|---|---|---|---|---|---|---|
| | 11 | 12 | 13 | 14 | 15 | 16 | 17 | 18 | 19 | 20 |
| THF-insoluble matter (mass %) | 12.3 | 10.1 | 9.8 | 8.8 | 17.3 | 16.7 | 20.8 | 19.9 | 22.1 | 32.3 |
| Proportion of silicon atom in the organic silicon polymer having structure represented by —SiO3/2 | 34.2 | 23.0 | 25.0 | 18.0 | 63.0 | 60.3 | 50.4 | 51.9 | 51.7 | 48.0 |
| Silicon atom density of toner particle surface (atom %) | 3.1 | 1.8 | 1.1 | 0.8 | 13.3 | 13.2 | 15.3 | 14.3 | 13.2 | 18.3 |
| Average thickness Dav. of the surface layer (nm) | 10.5 | 5.3 | 4.3 | 2.7 | 20.3 | 20.6 | 29.3 | 30.1 | 29.8 | 56.0 |
| Proportion of surface layer having thickness of not more than 5.0 nm (%) | 19.7 | 20.4 | 56.0 | 89.0 | 5.3 | 4.1 | 0.0 | 0.0 | 0.0 | 0.0 |
| Weight-average particle diameter (μm) | 5.7 | 5.6 | 5.9 | 5.5 | 5.8 | 5.5 | 5.8 | 5.6 | 5.7 | 6.0 |
| Number-average particle diameter (μm) | 4.9 | 4.7 | 5.1 | 4.6 | 4.9 | 4.7 | 4.9 | 4.7 | 4.8 | 5.2 |
| Endothermic main peak (° C.) | 70.2 | 70.3 | 70.2 | 70.3 | 70.2 | 70.4 | 70.3 | 70.0 | 70.3 | 70.3 |
| calorimetric integral value (J/g) | 19.1 | 19.1 | 19.1 | 19.4 | 19.5 | 19.5 | 19.4 | 19.1 | 19.1 | 19.2 |
| Glass transition temperature (° C.) | 47.3 | 47.6 | 47.2 | 48.1 | 50.3 | 48.2 | 47.3 | 45.3 | 44.6 | 51.5 |
| 80° C. viscosity (Pa · s) | 23200 | 23000 | 22500 | 22600 | 19600 | 19700 | 19200 | 19400 | 19300 | 12600 |

TABLE 8

| | Toner particle | | | | | | | | |
|---|---|---|---|---|---|---|---|---|---|
| | 21 | 22 | 23 | 24 | 25 | 26 | 27 | 28 | 29 |
| THF-insoluble matter (mass %) | 30.8 | 33.1 | 7.8 | 6.8 | 40.2 | 38.2 | 16.1 | 16.7 | 16.9 |
| Proportion of silicon atom in the organic silicon polymer having structure represented by —SiO3/2 | 51.0 | 49.0 | 10.5 | 5.2 | 67.0 | 68.0 | 57.3 | 59.7 | 60.3 |
| Silicon atom density of toner particle surface (atom %) | 19.1 | 17.9 | 12.8 | 11.5 | 9.8 | 5.3 | 10.9 | 11.7 | 11.2 |
| Average thickness Dav. of the surface layer (nm) | 61.0 | 62.0 | 41.8 | 44.3 | 34.5 | 29.8 | 22.3 | 19.3 | 18.9 |

TABLE 8-continued

| | Toner particle | | | | | | | | |
|---|---|---|---|---|---|---|---|---|---|
| | 21 | 22 | 23 | 24 | 25 | 26 | 27 | 28 | 29 |
| Proportion of surface layer having thickness of not more than 5.0 nm (%) | 0.0 | 0.0 | 0.0 | 0.0 | 0.0 | 0.0 | 3.1 | 4.1 | 5.6 |
| Weight-average particle diameter (μm) | 5.5 | 5.5 | 5.5 | 5.9 | 5.7 | 5.8 | 5.5 | 5.6 | 5.9 |
| Number-average particle diameter (μm) | 4.7 | 4.6 | 4.7 | 5.0 | 4.7 | 4.9 | 4.6 | 4.7 | 5.0 |
| Endothermic main peak (° C.) | 70.4 | 70.3 | 70.0 | 70.1 | 70.2 | 70.4 | 70.4 | 70.2 | 70.3 |
| calorimetric integral value (J/g) | 19.4 | 19.3 | 19.0 | 19.3 | 19.3 | 19.3 | 19.3 | 19.5 | 19.0 |
| Glass transition temperature (° C.) | 52.1 | 48.3 | 49.1 | 50.1 | 48.1 | 49.1 | 47.8 | 48.3 | 48.1 |
| 80° C. viscosity (Pa · s) | 15400 | 15000 | 23200 | 23300 | 19400 | 19300 | 17200 | 17000 | 17800 |

TABLE 9

| | Comparative toner particle | | | | | | | | |
|---|---|---|---|---|---|---|---|---|---|
| | 1 | 2 | 3 | 4 | 5 | 6 | 7 | 8 | 9 |
| THF-insoluble matter (mass %) | 13.0 | 3.9 | 4.3 | 17.3 | 17.3 | 21.2 | 42.3 | 0.3 | 24.3 |
| Proportion of silicon atom in the organic silicon polymer having structure represented by —SiO3/2 | 29.0 | 40.0 | 4.3 | 53.0 | 53.0 | 11.8 | 49.0 | — | 45.3 |
| Silicon atom density of toner particle surface (atom %) | 11.2 | 12.5 | 4.8 | 13.1 | 13.1 | 12.3 | 23.0 | — | 0.7 |
| Average thickness Dav. of the surface layer (nm) | 44.8 | 51.3 | 13.0 | 22.0 | 22.0 | 41.8 | 125.0 | — | — |
| Proportion of surface layer having thickness of not more than 5.0 nm (%) | 0.0 | 0.0 | 0.0 | 3.1 | 3.1 | 0.0 | 0.0 | — | — |
| Weight-average particle diameter (μm) | 5.8 | 5.7 | 5.7 | 5.4 | 5.6 | 5.8 | 5.5 | 5.6 | 6.1 |
| Number-average particle diameter (μm) | 4.9 | 4.7 | 4.9 | 4.5 | 4.7 | 5.0 | 4.5 | 4.7 | 4.6 |
| Endothermic main peak (° C.) | 70.2 | 70.3 | 70.2 | 70.2 | 70.3 | 70.1 | 70.0 | 70.0 | 70.1 |
| calorimetric integral value (J/g) | 19.4 | 19.0 | 19.3 | 19.1 | 19.2 | 19.4 | 19.5 | 19.3 | 19.2 |
| Glass transition temperature (° C.) | 48.1 | 47.3 | 50.1 | 40.3 | 50.2 | 48.9 | 42.1 | 48.1 | 48.3 |
| 80° C. viscosity (Pa · s) | 16500 | 17300 | 23200 | 20200 | 18900 | 20600 | 24200 | 10500 | 17500 |

Production Example of Toner 1

0.6 parts by mass of hydrophobic silica, having a specific surface area as determined by BET of 200 $m^2/g$ and subjected to hydrophobic treatment with 4.0% by mass of hexamethyldisilazane and 3% by mass of 100 cps silicone oil, and 0.2 part by mass of aluminum oxide, having a specific surface area as determined by BET of 50 $m^2/g$, were mixed with 100 parts by mass of toner particle 1 with a HENSCHEL® mixer (Mitsui Mining Co., Ltd.), and the resulting toner was designated as toner 1.

Production Examples of Toners 2 to 29

Toners 2 to 29 were obtained in the same manner as the production example of toner 1 with the exception of changing the toner particle 1 used in the production example of toner 1 to toner particles 2 to 29.

Production Example of Comparative Toners 1 to 9

Comparative toners 1 to 9 were obtained in the same manner as the production example of toner 1 with the exception of changing the toner particle 1 used in the production example of toner 1 to comparative toner particles 1 to 9.

The above-mentioned toners were evaluated for the following parameters.

(Evaluation of Storage Stability)

(Evaluation of Storability)

Approximately 10 g of toner were placed in a 100 mL glass bottle and allowed to stand for 15 days at a temperature of 50° C. and humidity of 20% followed by a visual assessment of the toner.

A: No change

B: Some aggregates but soon broken up

C: Aggregates difficult to break up

D: No flowability

E: Definite occurrence of caking (Evaluation of Long-Term Storability)

Approximately 10 g of toner were placed in a 100 mL glass bottle and allowed to stand for 3 months at a temperature of 45° C. and humidity of 95% followed by a visual assessment of the toner.

A: No change

B: Some aggregates but soon broken up

C: Aggregates difficult to break up

D: No flowability

E: Definite occurrence of caking (Evaluation of Environmental Stability and Development Durability)

Evaluation was carried out using the HP Color LaserJet Enterprise CP4525dn color laser beam printer manufactured by Hewlett-Packard Co. (to also be referred to as the "CP4525") modified to allow image output with a single cartridge. Toner was removed from the dedicated CP4525 toner cartridge and filled with 250 g of the toner to be evaluated. The toner cartridge filled with the evaluated toner was allowed to stand for 24 hours in respective environments consisting of a low temperature, low humidity L/L environment (10° C./15% RH), normal temperature, normal humidity N/N environment (25° C./50% RH) and high temperature, high humidity H/H environment (32.5° C./85% RH).

After allowing to stand for 24 hours in each environment, the toner cartridge was installed in the above-mentioned CP4525 and initial evaluated images (toner laid-on level: 0.40 mg/cm$^2$) were printed out. Next, 25,000 images having a print percentage of 1.0% were printed out in the A4 longitudinal direction. After printing out 25,000 images, the evaluated image was again printed out followed by evaluating density and density uniformity of the evaluated image after printing out the initial evaluated image and after printing out 25,000 images, and evaluating contamination of members after printing out the 25,000 images. In addition, the toner inside the cartridge was sampled for use as toner following environmental stability and development durability testing.

On the other hand, the toner cartridge filled with the evaluated toner was allowed to stand for 168 hours in a harsh environment (40° C./90% RH). Subsequently, the toner cartridge was further allowed to stand for 24 hours in super high temperature, high humidity SHH environment (35.0° C./85% RH). After standing for 24 hours in the super high temperature, high humidity environment, the toner cartridge was installed in the above-mentioned CP4525 and an initial evaluated image was printed out. Next, 25,000 images having a print percentage of 1.0% were printed out in the A4 longitudinal direction. An evaluated image was again printed out after printing out the 25,000 images followed by evaluating density and density uniformity of the evaluated image after printing out the initial evaluated image and after printing out 25,000 images, and evaluating contamination of members after printing out the 25,000 images. In addition, the toner inside the cartridge was sampled for use as toner following environmental stability and development durability testing.

The evaluated images consisted of white paper, 3 solid image chart images covering the entire surface of white paper (toner laid-on level: 0.40 g/cm$^2$) and an image having a half-tone image on the first half and a solid image chart on the lower half.

A4-size CS-814 paper (Canon Inc., 81.4 g/m$^2$) was used for the transfer material.

(Measurement of Toner Triboelectric Charge Quantity)

Triboelectric charge quantity was measured according to the procedure indicated below for the toner prior to the above-mentioned environmental stability and development durability testing and toner following the above-mentioned environmental stability and development durability testing.

First, the toner prior to the above-mentioned environmental stability and development durability testing was evaluated by allowing the toner and a standard carrier for a negatively charged polar toner (trade name: N-01, Imaging Society of Japan) to stand for a prescribed amount of time in the following environments: allowed to stand for 24 hours in a low temperature, low humidity environment (10° C./15% RH), allowed to stand for 24 hours in a normal temperature, normal humidity environment (25° C./50% RH), allowed to stand for 24 hours in a high temperature, high humidity environment (32.5° C./85% RH), and allowed to stand for 168 hours in a harsh environment (40° C./95% RH) followed by allowing to stand for 24 hours in a super high temperature, high humidity environment (35.0° C./85% RH).

In addition, the toner following the above-mentioned environmental stability and development durability testing was used after allowing to stand for 24 hours in the environment following testing.

Following standing, each toner and standard carrier were mixed for 120 seconds using a turbula mixer in each of the environments so that the amount of the toner was 5% by mass. Next, within 1 minute after mixing in a developer after mixing, the mixture was placed in a metal container having an electrically conductive screen having a pore size of 20 μm attached to the bottom thereof in an environment at normal temperature and normal humidity (25° C./50% RH) followed by aspirating with an aspirator and measuring the difference in mass before and after aspiration and the electrical potential that accumulated in a capacitor connected to the container. At this time, the aspiration pressure was 4.0 kPa. Triboelectric charge quantity of the toner was calculated using the following equation from the above-mentioned difference in mass before and after aspiration, the accumulated electrical potential, and the capacity of the capacitor.

The standard carrier for negatively charged polar toner (trade name: N-01, Imaging Society of Japan) used in the measurement was used after passing through a 250 mesh sieve.

$$Q=(A\times B)/(W1-W2)$$

Q (mC/kg): Toner triboelectric charge quantity

A (μF): Capacity of capacitor

B (V): Electrical potential difference accumulated in capacitor

W1−W2 (kg): Mass difference before and after aspiration (Evaluation of Image Density)

Image density was measured using a Macbeth reflection densitometer (trade name: RD-918, Macbeth Corp.). Measurements were made at five locations in the upper left corner, upper right corner, center, lower left corner and lower right corner for each of the above-mentioned solid image chart images. In addition, measurements were similarly made at five locations in the upper left corner, upper right corner, center, lower left corner and lower right corner for white paper images as well. The difference between the average value of the total of fifteen locations measured for the three solid image chart images and the average value of the total of five locations measured for the white paper image was taken to be the image density. The evaluation criteria are as indicated below.

A: Image density of 1.40 to 1.50

B: Image density of 1.35 to less than 1.40 or greater than 1.50 to 1.55

C: Image density of 1.25 to less than 1.35 or greater than 1.55 to 1.65

D: Image density of 1.20 to less than 1.25 or greater than 1.65 to 1.70

E: Image density of less than 1.20 or greater than 1.70

An evaluation of D or better was judged to constitute a preferable level.

(Evaluation of Image Density Uniformity)

Image density uniformity was measured using a Macbeth reflection densitometer (trade name: RD-918, Macbeth Corp.). Measurements were made at five locations in the upper left corner, upper right corner, center, lower left corner and lower right corner for each solid image chart image. The difference between the maximum value and minimum value of the five locations was measured and the average value of the three images was calculated and evaluated. The evaluation criteria are as indicated below.

A: Difference in image density of 0.03 or less

B: Difference in image density of greater than 0.03 to 0.06

C: Difference in image density of greater than 0.06 to 0.08

D: Difference in image density of greater than 0.08 to 0.10

E: Difference in image density of greater than 0.10

An evaluation of D or better was judged to constitute a preferable level.

(Evaluation of Contamination of Members)

Contamination of members was evaluated in accordance with the following criteria by printing out images in which the first half of images was formed with a halftone image and the second half was formed with a solid image after printing out 25,000 images.

A: Vertical streaks in the direction of paper ejection not visible on the developing roller, half tone portion or solid portion of images.

B: One to two narrow streaks present in the circumferential direction on both ends of the developing roller, but vertical streaks in the direction of paper ejection not visible on the halftone portion or solid portion of images.

C: Three to five narrow streaks present in the circumferential direction on both ends of the developing roller, and very few vertical streaks in the direction of paper ejection observed on the halftone portion or solid portion of images, but only observed to a degree that can be removed by image processing.

D: Six to twenty narrow streaks present in the circumferential direction on both ends of the developing roller, and several narrow streaks also observed on the halftone portion or solid portion of images that are unable to be removed by image processing.

E: Twenty or more streaks observed on the developing roller and the halftone portion of images and are unable to be removed by image processing.

An evaluation of D or better was judged to constitute a preferable level.

(Evaluation of Low-Temperature Fixability (Temperature at Completion of Cold Offset))

The fixing unit of the CP4525 laser beam printer was modified to enable adjustment of fixation temperature. The modified fixing unit was then used to form fixed images on image receiving paper by hot-pressing unfixed images onto image receiving paper in the absence of oil at a process speed of 240 mm/sec and toner laid-on level of 0.60 mg/cm$^2$.

Fixing performance was evaluated by rubbing the fixed images ten times with a Kimwipe (trade name: S-200, Nippon Paper Crecia Co., Ltd.) while applying a load of 75 g/cm$^2$ and taking the temperature at which the rate of decrease in density before and after rubbing was less than 5% to be the temperature at completion of cold offset. This evaluation was carried out at normal temperature and normal humidity (25° C., 50% RH).

Letter-size Xerox Business 4200 paper (75 g/m$^2$, Xerox Corp.) was used for the transfer material. The evaluation criteria are as indicated below.

A: Temperature at which rate of decrease in density before and after rubbing is less than 5% is lower than 140° C.

B: Temperature at which rate of decrease in density before and after rubbing is less than 5% is 140° C. to lower than 150° C.

C: Temperature at which rate of decrease in density before and after rubbing is less than 5% is 150° C. to lower than 160° C.

D: Temperature at which rate of decrease in density before and after rubbing is less than 5% is 160° C. to lower than 170° C.

E: Temperature at which rate of decrease in density before and after rubbing is less than 5% is 170° C. or higher An evaluation of D or better was judged to constitute a preferable level.

Example 1

The above-mentioned evaluations were carried out on toner 1. Evaluation results were favorable for all parameters. Evaluation results are shown in Table 10.

Examples 2 to 29

Toners 2 to 29 were evaluated in the same manner as Example 1. Evaluation results are shown in Tables 10 to 12.

Comparative Example 1

The above-mentioned evaluations were carried out on comparative toner 1. Long-term storability was significantly inferior and of a level that prevented practical use. In addition, since environmental stability and development durability were also inferior, the toner was determined to have a problem with respect to image density uniformity. Evaluation results are shown in Table 13.

Comparative Examples 2 to 9

Comparative toners 2 to 9 were evaluated in the same manner a comparative toner 1. Due to the inferior storage stability thereof, the SHH evaluation was unable to be carried out on comparative toners 2, 8 and 9. In addition, comparative toners 8 and 9 had problems with development durability such that, although the initial image was able to be printed out, it became no longer possible to carry out evaluations during the course of evaluation. The results of other evaluations are shown in Table 13.

TABLE 10

| | | | | Example | | | | |
|---|---|---|---|---|---|---|---|---|
| | | | | 1 | 2 | 3 | 4 | 5 |
| | | | | Toner | | | | |
| | | | | 1 | 2 | 3 | 4 | 5 |
| Storage stability | | | Storability (50° C./15 days) | A | A | A | A | A |
| | | | Long-term storability (45° C./95%/3 months) | A | A | A | A | A |
| Environmental stability and development durability | NN | Initial | Tribo (mC/kg) | −45.6 | −45.6 | −45.0 | −45.4 | −46.0 |
| | | | Density | 1.45 (A) | 1.46 (A) | 1.47 (A) | 1.45 (A) | 1.42 (A) |
| | | | Density uniformity | 0.00 (A) | 0.01 (A) | 0.00 (A) | 0.01 (A) | 0.02 (A) |
| | | After 25,000 prints | Tribo (mC/kg) | −44.8 | −45.3 | −44.3 | −44.3 | −44.9 |
| | | | Density | 1.46 (A) | 1.48 (A) | 1.48 (A) | 1.43 (A) | 1.42 (A) |
| | | | Density uniformity | 0.01 (A) | 0.02 (A) | 0.01 (A) | 0.02 (A) | 0.01 (A) |
| | | | Member contamination | A | A | A | A | A |
| | LL | Initial | Tribo (mC/kg) | −46.4 | −46.7 | −49.1 | −48.3 | −49.1 |
| | | | Density | 1.46 (A) | 1.47 (A) | 1.46 (A) | 1.41 (A) | 1.41 (A) |
| | | | Density uniformity | 0.00 (A) | 0.01 (A) | 0.01 (A) | 0.01 (A) | 0.01 (A) |
| | | After 25,000 prints | Tribo (mC/kg) | −48.0 | −49.1 | −49.2 | −49.3 | −50.1 |
| | | | Density | 1.47 (A) | 1.48 (A) | 1.48 (A) | 1.46 (A) | 1.47 (A) |
| | | | Density uniformity | 0.00 (A) | 0.01 (A) | 0.02 (A) | 0.04 (B) | 0.05 (B) |
| | | | Member contamination | A | A | A | B | B |
| | HH | Initial | Tribo (mC/kg) | −43.5 | −44.3 | −43.5 | −43.3 | −44.1 |
| | | | Density | 1.46 (A) | 1.49 (A) | 1.49 (A) | 1.43 (A) | 1.44 (A) |
| | | | Density uniformity | 0.01 (A) | 0.02 (A) | 0.01 (A) | 0.02 (A) | 0.01 (A) |
| | | After 25,000 prints | Tribo (mC/kg) | −43.1 | −42.8 | −43.1 | −42.5 | −42.3 |
| | | | Density | 1.45 (A) | 1.46 (A) | 1.46 (A) | 1.43 (A) | 1.42 (A) |
| | | | Density uniformity | 0.01 (A) | 0.03 (A) | 0.01 (A) | 0.01 (A) | 0.02 (A) |
| | | | Member contamination | A | A | A | A | A |
| | SHH | Initial | Tribo (mC/kg) | −44.0 | −43.2 | −43.1 | −40.3 | −41.0 |
| | | | Density | 1.41 (A) | 1.43 (A) | 1.42 (A) | 1.42 (A) | 1.41 (A) |
| | | | Density uniformity | 0.01 (A) | 0.01 (A) | 0.01 (A) | 0.01 (A) | 0.01 (A) |
| | | After 25,000 prints | Tribo (mC/kg) | −43.2 | −44.3 | −43.5 | −42.3 | −43.2 |
| | | | Density | 1.43 (A) | 1.46 (A) | 1.43 (A) | 1.42 (A) | 1.43 (A) |
| | | | Density uniformity | 0.01 (A) | 0.03 (A) | 0.01 (A) | 0.03 (A) | 0.03 (A) |
| | | | Member contamination | A | A | A | A | A |
| Low-temperature | Cold offset completion Temp. (° C.) | | | 125 (A) | 125 (A) | 125 (A) | 135 (A) | 135 (A) |

| | | | | Example | | | | |
|---|---|---|---|---|---|---|---|---|
| | | | | 6 | 7 | 8 | 9 | 10 |
| | | | | Toner | | | | |
| | | | | 6 | 7 | 8 | 9 | 10 |
| Storage stability | | | Storability (50° C./15 days) | A | A | A | A | A |

TABLE 10-continued

| | | | | | | | | |
|---|---|---|---|---|---|---|---|---|
| | | | Long-term storability (45° C./95%/ 3 months) | A | A | A | A | A |
| Environmental stability and development durability | NN | Initial | Tribo (mC/kg) | −46.2 | −45.8 | −46.3 | −46.6 | −45.6 |
| | | | Density | 1.48 (A) | 1.43 (A) | 1.42 (A) | 1.48 (A) | 1.42 (A) |
| | | | Density uniformity | 0.01 (A) | 0.02 (A) | 0.01 (A) | 0.02 (A) | 0.01 (A) |
| | | After 25,000 prints | Tribo (mC/kg) | −44.8 | −43.8 | −44.3 | −44.5 | −42.3 |
| | | | Density | 1.45 (A) | 1.43 (A) | 1.42 (A) | 1.43 (A) | 1.41 (A) |
| | | | Density uniformity | 0.01 (A) | 0.01 (A) | 0.01 (A) | 0.02 (A) | 0.03 (A) |
| | | | Member contamination | A | A | A | A | A |
| | LL | Initial | Tribo (mC/kg) | −47.6 | −46.9 | −46.8 | −46.9 | −47.9 |
| | | | Density | 1.43 (A) | 1.44 (A) | 1.43 (A) | 1.42 (A) | 1.44 (A) |
| | | | Density uniformity | 0.01 (A) | 0.02 (A) | 0.02 (A) | 0.01 (A) | 0.01 (A) |
| | | After 25,000 prints | Tribo (mC/kg) | −52.3 | −48.9 | −52.3 | −53.5 | −55.1 |
| | | | Density | 1.48 (A) | 1.46 (A) | 1.51 (B) | 1.52 (B) | 1.54 (B) |
| | | | Density uniformity | 0.06 (B) | 0.03 (A) | 0.03 (A) | 0.04 (B) | 0.04 (B) |
| | | | Member contamination | B | B | B | B | B |
| | HH | Initial | Tribo (mC/kg) | −41.2 | −43.5 | −42.3 | −41.2 | −42.3 |
| | | | Density | 1.43 (A) | 1.45 (A) | 1.41 (A) | 1.43 (A) | 1.41 (A) |
| | | | Density uniformity | 0.01 (A) | 0.02 (A) | 0.02 (A) | 0.01 (A) | 0.03 (A) |
| | | After 25,000 prints | Tribo (mC/kg) | −41.0 | −42.8 | −41.5 | −42.3 | −39.5 |
| | | | Density | 1.44 (A) | 1.41 (A) | 1.41 (A) | 1.41 (A) | 1.38 (B) |
| | | | Density uniformity | 0.04 (B) | 0.03 (A) | 0.03 (A) | 0.03 (A) | 0.03 (A) |
| | | | Member contamination | A | A | A | A | B |
| | SHH | Initial | Tribo (mC/kg) | −40.3 | −41.5 | −39.7 | −39.8 | −34.3 |
| | | | Density | 1.41 (A) | 1.43 (A) | 1.41 (A) | 1.40 (A) | 1.32 (C) |
| | | | Density uniformity | 0.02 (A) | 0.00 (A) | 0.02 (A) | 0.02 (A) | 0.01 (A) |
| | | After 25,000 prints | Tribo (mC/kg) | −44.5 | −41.5 | −41.4 | −41.2 | −39.3 |
| | | | Density | 1.41 (A) | 1.44 (A) | 1.43 (A) | 1.42 (A) | 1.29 (C) |
| | | | Density uniformity | 0.04 (B) | 0.01 (A) | 0.03 (A) | 0.03 (A) | 0.02 (A) |
| | | | Member contamination | A | A | B | B | B |
| Low-temperature | Cold offset completion Temp. (° C.) | | | 135 (A) | 130 (A) | 150 (C) | 150 (C) | 145 (B) |

TABLE 11

| | | | | Example | | | | |
|---|---|---|---|---|---|---|---|---|
| | | | | 11 | 12 | 13 | 14 | 15 |
| | | | | Toner | | | | |
| | | | | 11 | 12 | 13 | 14 | 15 |
| Storage stability | | | Storability (50° C./ 15 days) | B | B | B | C | A |
| | | | Long-term storability (45° C./95%/ 3 months) | A | A | B | C | A |
| Environmental stability and development durability | NN | Initial | Tribo (mC/kg) | −45.2 | −45.7 | −46.0 | −45.3 | −45.6 |
| | | | Density | 1.42 (A) | 1.44 (A) | 1.43 (A) | 1.44 (A) | 1.41 (A) |
| | | | Density uniformity | 0.01 (A) | 0.02 (A) | 0.03 (A) | 0.02 (A) | 0.01 (A) |

TABLE 11-continued

| | | | | | | | | |
|---|---|---|---|---|---|---|---|---|
| | | After 25,000 prints | Tribo (mC/kg) | −43.1 | −42.3 | −40.3 | −39.8 | −41.9 |
| | | | Density | 1.42 (A) | 1.43 (A) | 1.39 (B) | 1.35 (B) | 1.42 (A) |
| | | | Density uniformity | 0.02 (A) | 0.01 (A) | 0.03 (A) | 0.04 (B) | 0.01 (A) |
| | | | Member contamination | A | A | A | B | A |
| | LL | Initial | Tribo (mC/kg) | −48.3 | −43.9 | −43.5 | −47.3 | −43.5 |
| | | | Density | 1.43 (A) | 1.42 (A) | 1.43 (A) | 1.42 (A) | 1.44 (A) |
| | | | Density uniformity | 0.02 (A) | 0.03 (A) | 0.01 (A) | 0.01 (A) | 0.01 (A) |
| | | After 25,000 prints | Tribo (mC/kg) | −52.3 | −53.5 | −52.1 | −56.3 | −48.7 |
| | | | Density | 1.51 (B) | 1.52 (B) | 1.51 (B) | 1.56 (C) | 1.45 (A) |
| | | | Density uniformity | 0.06 (B) | 0.07 (C) | 0.09 (D) | 0.10 (D) | 0.02 (A) |
| | | | Member contamination | B | B | B | B | A |
| | HH | Initial | Tribo (mC/kg) | −42.3 | −43.2 | −42.1 | −41.1 | −43.0 |
| | | | Density | 1.43 (A) | 1.42 (A) | 1.42 (A) | 1.42 (A) | 1.41 (A) |
| | | | Density uniformity | 0.01 (A) | 0.01 (A) | 0.01 (A) | 0.01 (A) | 0.01 (A) |
| | | After 25,000 prints | Tribo (mC/kg) | −39.5 | −38.3 | −35.2 | −34.3 | −41.2 |
| | | | Density | 1.37 (B) | 1.36 (B) | 1.33 (C) | 1.32 (C) | 1.42 (A) |
| | | | Density uniformity | 0.01 (A) | 0.02 (A) | 0.01 (A) | 0.02 (A) | 0.01 (A) |
| | | | Member contamination | B | B | B | B | A |
| | SHH | Initial | Tribo (mC/kg) | −37.5 | −36.5 | −38.5 | −34.3 | −41.5 |
| | | | Density | 1.31 (C) | 1.34 (C) | 1.23 (D) | 1.25 (C) | 1.43 (A) |
| | | | Density uniformity | 0.02 (A) | 0.01 (A) | 0.02 (A) | 0.04 (B) | 0.01 (A) |
| | | After 25,000 prints | Tribo (mC/kg) | −38.5 | −39.8 | −39.8 | −39.2 | −41.3 |
| | | | Density | 1.32 (C) | 1.31 (C) | 1.24 (D) | 1.21 (D) | 1.42 (A) |
| | | | Density uniformity | 0.02 (A) | 0.01 (A) | 0.03 (A) | 0.06 (B) | 0.01 (A) |
| | | | Member contamination | B | B | B | C | A |
| Low-temperature | Cold offset completion Temp. (° C.) | | | 140 (B) | 140 (B) | 135 (A) | 130 (A) | 155 (C) |

| | | | | Example | | | | |
|---|---|---|---|---|---|---|---|---|
| | | | | 16 | 17 | 18 | 19 | 20 |
| | | | | Toner | | | | |
| | | | | 16 | 17 | 18 | 19 | 20 |
| Storage stability | | | Storability (50° C./15 days) | A | A | A | B | C |
| | | | Long-term storability (45° C./95%/3 months) | A | A | B | B | C |
| Environmental stability and development durability | NN | Initial | Tribo (mC/kg) | −46.0 | −45.3 | −45.9 | −46.1 | −45.9 |
| | | | Density | 1.43 (A) | 1.46 (A) | 1.43 (A) | 1.43 (A) | 1.42 (A) |
| | | | Density uniformity | 0.00 (A) | 0.00 (A) | 0.01 (A) | 0.02 (A) | 0.00 (A) |
| | | After 25,000 prints | Tribo (mC/kg) | −42.3 | −44.2 | −43.3 | −44.2 | −43.3 |
| | | | Density | 1.42 (A) | 1.46 (A) | 1.42 (A) | 1.43 (A) | 1.41 (A) |
| | | | Density uniformity | 0.01 (A) | 0.00 (A) | 0.01 (A) | 0.02 (A) | 0.04 (B) |
| | | | Member contamination | A | A | A | A | B |
| | LL | Initial | Tribo (mC/kg) | −42.3 | −48.7 | −48.3 | −47.6 | −48.3 |
| | | | Density | 1.42 (A) | 1.46 (A) | 1.44 (A) | 1.43 (A) | 1.46 (A) |
| | | | Density uniformity | 0.00 (A) | 0.01 (A) | 0.00 (A) | 0.01 (A) | 0.02 (A) |
| | | After 25,000 | Tribo (mC/kg) | −46.3 | −49.3 | −47.8 | −49.3 | −50.3 |

TABLE 11-continued

| | | | | | | | | |
|---|---|---|---|---|---|---|---|---|
| | | prints | Density | 1.43 (A) | 1.46 (A) | 1.43 (A) | 1.42 (A) | 1.51 (B) |
| | | | Density uniformity | 0.02 (A) | 0.02 (A) | 0.02 (A) | 0.03 (A) | 0.08 (C) |
| | | | Member contamination | A | A | A | A | C |
| | HH | Initial | Tribo (mC/kg) | −42.3 | −44.0 | −42.3 | −41.3 | −43.5 |
| | | | Density | 1.43 (A) | 1.43 (A) | 1.43 (A) | 1.41 (A) | 1.45 (A) |
| | | | Density uniformity | 0.02 (A) | 0.01 (A) | 0.01 (A) | 0.02 (A) | 0.01 (A) |
| | | After 25,000 prints | Tribo (mC/kg) | −41.2 | −42.1 | −42.3 | −41.4 | −34.2 |
| | | | Density | 1.44 (A) | 1.46 (A) | 1.41 (A) | 1.42 (A) | 1.30 (C) |
| | | | Density uniformity | 0.01 (A) | 0.01 (A) | 0.01 (A) | 0.02 (A) | 0.05 (B) |
| | | | Member contamination | A | A | A | A | C |
| | SHH | Initial | Tribo (mC/kg) | −42.0 | −42.1 | −39.5 | −34.5 | −39.5 |
| | | | Density | 1.43 (A) | 1.42 (A) | 1.39 (B) | 1.35 (B) | 1.38 (B) |
| | | | Density uniformity | 0.02 (A) | 0.01 (A) | 0.04 (B) | 0.04 (B) | 0.03 (A) |
| | | After 25,000 prints | Tribo (mC/kg) | −42.3 | −40.1 | −40.1 | −39.5 | −35.6 |
| | | | Density | 1.41 (A) | 1.40 (A) | 1.35 (B) | 1.33 (C) | 1.33 (C) |
| | | | Density uniformity | 0.01 (A) | 0.01 (A) | 0.01 (A) | 0.02 (A) | 0.02 (A) |
| | | | Member contamination | A | A | A | A | C |
| Low-temperature | Cold offset completion Temp. (° C.) | | | 145 (B) | 135 (A) | 130 (A) | 130 (A) | 130 (A) |

TABLE 12

| | | | | Example | | | | | | | | |
|---|---|---|---|---|---|---|---|---|---|---|---|---|
| | | | | 21 | 22 | 23 | 24 | 25 | 26 | 27 | 28 | 29 |
| | | | | Toner | | | | | | | | |
| | | | | 21 | 22 | 23 | 24 | 25 | 26 | 27 | 28 | 29 |
| Storage stability | | | Storability (50° C./15 days) | B | A | B | B | A | B | A | A | A |
| | | | Long-term storability (45° C./95%/3 months) | C | B | A | B | B | B | A | A | A |
| Environmental stability and development durability | NN | Initial | Tribo (mC/kg) | −46.2 | −46.2 | −45.3 | −45.8 | −45.1 | −46.8 | −45.0 | −45.8 | −46.5 |
| | | | Density | 1.43 (A) | 1.44 (A) | 1.43 (A) | 1.41 (A) | 1.43 (A) | 1.43 (A) | 1.50 (A) | 1.46 (A) | 1.42 (A) |
| | | | Density uniformity | 0.01 (A) | 0.02 (A) | 0.00 (A) | 0.00 (A) | 0.02 (A) | 0.03 (A) | 0.02 (A) | 0.01 (A) | 0.00 (A) |
| | | After 25,000 prints | Tribo (mC/kg) | −44.0 | −43.0 | −43.1 | −42.3 | −50.3 | −45.8 | −44.3 | −44.9 | −45.0 |
| | | | Density | 1.42 (A) | 1.41 (A) | 1.43 (A) | 1.44 (A) | 1.49 (A) | 1.45 (A) | 1.48 (A) | 1.47 (A) | 1.41 (A) |
| | | | Density uniformity | 0.01 (A) | 0.01 (A) | 0.02 (A) | 0.04 (B) | 0.06 (B) | 0.03 (A) | 0.01 (A) | 0.00 (A) | 0.01 (A) |
| | | | Member contamination | A | A | A | A | A | A | A | A | A |
| | LL | Initial | Tribo (mC/kg) | −47.3 | −48.1 | −48.3 | −43.7 | −45.3 | −43.8 | −48.3 | −44.9 | −47.3 |
| | | | Density | 1.45 (A) | 1.46 (A) | 1.48 (A) | 1.46 (A) | 1.43 (A) | 1.44 (A) | 1.49 (A) | 1.45 (A) | 1.43 (A) |
| | | | Density uniformity | 0.01 (A) | 0.02 (A) | 0.03 (A) | 0.02 (A) | 0.01 (A) | 0.03 (A) | 0.01 (A) | 0.01 (A) | 0.00 (A) |
| | | After 25,000 prints | Tribo (mC/kg) | −51.3 | −45.9 | −51.3 | −53.3 | −57.2 | −50.3 | −48.2 | −45.1 | −46.7 |
| | | | Density | 1.48 (A) | 1.42 (A) | 1.51 (B) | 1.50 (A) | 1.55 (B) | 1.51 (B) | 1.45 (A) | 1.44 (A) | 1.41 (A) |
| | | | Density uniformity | 0.04 (B) | 0.02 (A) | 0.04 (B) | 0.04 (B) | 0.08 (C) | 0.05 (B) | 0.01 (A) | 0.01 (A) | 0.01 (A) |
| | | | Member contamination | C | A | A | A | A | A | A | A | A |
| | HH | Initial | Tribo (mC/kg) | −43.2 | −43.1 | −42.5 | −41.5 | −43.1 | −41.0 | −42.9 | −40.1 | −44.0 |

TABLE 12-continued

| | | | | Example | | | | | | | | |
|---|---|---|---|---|---|---|---|---|---|---|---|---|
| | | | | 21 | 22 | 23 | 24 | 25 | 26 | 27 | 28 | 29 |
| | | | | Toner | | | | | | | | |
| | | | | 21 | 22 | 23 | 24 | 25 | 26 | 27 | 28 | 29 |
| | | | Density | 1.43 (A) | 1.44 (A) | 1.41 (A) | 1.43 (A) | 1.42 (A) | 1.41 (A) | 1.45 (A) | 1.42 (A) | 1.39 (B) |
| | | | Density uniformity | 0.02 (A) | 0.00 (A) | 0.01 (A) | 0.03 (A) | 0.01 (A) | 0.02 (A) | 0.02 (A) | 0.01 (A) | 0.01 (A) |
| | | After 25,000 prints | Tribo (mC/kg) | −39.8 | −41.1 | −40.3 | −40.2 | −44.3 | −38.5 | −40.0 | −41.1 | −46.0 |
| | | | Density | 1.36 (B) | 1.41 (A) | 1.42 (A) | 1.41 (A) | 1.43 (A) | 1.38 (B) | 1.46 (A) | 1.43 (A) | 1.41 (A) |
| | | | Density uniformity | 0.04 (B) | 0.02 (A) | 0.04 (B) | 0.04 (B) | 0.03 (A) | 0.05 (B) | 0.02 (A) | 0.01 (A) | 0.01 (A) |
| | | | Member contamination | B | A | A | B | A | A | A | A | A |
| | SHH | Initial | Tribo (mC/kg) | −42.3 | −42.3 | −41.1 | −40.3 | −41.5 | −39.5 | −43.1 | −40.2 | −43.5 |
| | | | Density | 1.39 (B) | 1.41 (A) | 1.42 (A) | 1.41 (A) | 1.41 (A) | 1.38 (B) | 1.47 (A) | 1.42 (A) | 1.40 (A) |
| | | | Density uniformity | 0.03 (A) | 0.02 (A) | 0.05 (B) | 0.06 (B) | 0.01 (A) | 0.03 (A) | 0.01 (A) | 0.01 (A) | 0.02 (A) |
| | | After 25,000 prints | Tribo (mC/kg) | −39.5 | −38.9 | −40.3 | −39.8 | −41.1 | −39.4 | −40.3 | −41.3 | −42.1 |
| | | | Density | 1.35 (B) | 1.36 (B) | 1.41 (A) | 1.43 (A) | 1.41 (A) | 1.39 (B) | 1.44 (A) | 1.40 (A) | 1.41 (A) |
| | | | Density uniformity | 0.01 (A) | 0.02 (A) | 0.07 (C) | 0.08 (C) | 0.01 (A) | 0.02 (A) | 0.01 (A) | 0.01 (A) | 0.01 (A) |
| | | | Member contamination | B | A | B | B | A | A | A | A | A |
| Low-temperature | Cold offset completion Temp. (° C.) | | | 140 (B) | 135 (A) | 150 (C) | 140 (B) | 135 (A) | 135 (A) | 130 (A) | 130 (A) | 130 (A) |

TABLE 13

| | | | | Comparative Example | | | | | | | | |
|---|---|---|---|---|---|---|---|---|---|---|---|---|
| | | | | 1 | 2 | 3 | 4 | 5 | 6 | 7 | 8 | 9 |
| | | | | Comparative toner | | | | | | | | |
| | | | | 1 | 2 | 3 | 4 | 5 | 6 | 7 | 8 | 9 |
| Storage stability | | | Storability (50° C./15 days) | C | E | D | C | C | A | C | E | E |
| | | | Long-term storability (45° C./95%/3 months) | E | E | E | D | D | A | E | E | E |
| Environmental stability and development durability | NN | Initial | Tribo (mC/kg) | −45.2 | −27.5 | −46.7 | −45.4 | −46.7 | −46.3 | −46.2 | −45.9 | −45.9 |
| | | | Density | 1.41 (A) | 1.21 (D) | 1.42 (A) | 1.43 (A) | 1.43 (A) | 1.43 (A) | 1.41 (A) | 1.43 (A) | 1.43 (A) |
| | | | Density uniformity | 0.02 (A) | 0.06 (B) | 0.14 (E) | 0.03 (A) | 0.02 (A) | 0.00 (A) | 0.08 (C) | 0.02 (A) | 0.02 (A) |
| | | After 25,000 prints | Tribo (mC/kg) | −40.3 | −24.3 | −24.3 | −49.3 | −48.9 | −43.5 | −48.3 | Immeasurable due to discontinuation of evaluation | |
| | | | Density | 1.34 (C) | 1.27 (C) | 1.31 (C) | 1.48 (A) | 1.50 (A) | 1.42 (A) | 1.46 (A) | | |
| | | | Density uniformity | 0.05 (B) | 0.08 (C) | 0.31 (E) | 0.04 (B) | 0.05 (B) | 0.02 (A) | 0.03 (A) | | |
| | | | Member contamination | B | C | D | C | D | A | B | | |
| | LL | Initial | Tribo (mC/kg) | −41.5 | −28.9 | −38.5 | −42.5 | −43.5 | −42.3 | −43.1 | −65.3 | −49.3 |
| | | | Density | 1.29 (C) | 1.05 (E) | 1.39 (B) | 1.43 (A) | 1.44 (A) | 1.43 (A) | 1.44 (A) | 1.55 (B) | 1.38 (B) |
| | | | Density uniformity | 0.03 (A) | 0.02 (A) | 0.09 (D) | 0.03 (A) | 0.02 (A) | 0.00 (A) | 0.01 (A) | 0.02 (A) | 0.02 (A) |
| | | After 25,000 prints | Tribo (mC/kg) | −62.3 | −36.3 | −65.3 | −50.3 | −59.3 | −48.1 | −50.3 | Immeasurable due to discontinuation of evaluation | |
| | | | Density | 1.61 (C) | 1.21 (D) | 1.66 (D) | 1.53 (B) | 1.68 (D) | 1.42 (A) | 1.41 (A) | | |
| | | | Density uniformity | 0.12 (E) | 0.03 (A) | 0.21 (E) | 0.08 (C) | 0.15 (E) | 0.02 (A) | 0.06 (B) | | |
| | | | Member contamination | C | C | D | C | E | A | B | | |

TABLE 13-continued

| | | | | Comparative Example | | | | | | | | |
|---|---|---|---|---|---|---|---|---|---|---|---|---|
| | | | | 1 | 2 | 3 | 4 | 5 | 6 | 7 | 8 | 9 |
| | | | | Comparative toner | | | | | | | | |
| | | | | 1 | 2 | 3 | 4 | 5 | 6 | 7 | 8 | 9 |
| | HH | Initial | Tribo (mC/kg) | −42.3 | −19.5 | −31.5 | −42.1 | −43.2 | −42.3 | −42.3 | −35.8 | −38.3 |
| | | | Density | 1.41 (A) | 1.10 (E) | 1.30 (C) | 1.42 (A) | 1.41 (A) | 1.42 (A) | 1.44 (A) | 1.31 (C) | 1.34 (C) |
| | | | Density uniformity | 0.03 (A) | 0.02 (A) | 0.13 (E) | 0.01 (A) | 0.02 (A) | 0.01 (A) | 0.02 (A) | 0.07 (C) | 0.05 (B) |
| | | After 25,000 prints | Tribo (mC/kg) | −26.3 | −16.5 | −23.5 | −42.3 | −41.5 | −42.1 | −41.8 | Immeasurable due to discontinuation of evaluation | |
| | | | Density | 1.31 (C) | 1.25 (C) | 1.20 (D) | 1.41 (A) | 1.38 (B) | 1.44 (A) | 1.38 (B) | | |
| | | | Density uniformity | 0.11 (E) | 0.01 (A) | 0.11 (E) | 0.02 (A) | 0.01 (A) | 0.02 (A) | 0.08 (C) | | |
| | | | Member contamination | C | D | D | B | C | A | D | | |
| | SHH | Initial | Tribo (mC/kg) | −31.5 | Unable to be evaluated | −29.5 | −41.3 | −42.3 | −41.3 | −25.3 | Unable to be evaluated | |
| | | | Density | 1.25 (C) | | 1.23 (D) | 1.41 (A) | 1.42 (A) | 1.43 (A) | 1.18 (E) | | |
| | | | Density uniformity | 0.10 (D) | | 0.10 (D) | 0.04 (B) | 0.03 (A) | 0.03 (A) | 0.13 (E) | | |
| | | After 25,000 prints | Tribo (mC/kg) | −24.3 | | −19.8 | −33.1 | −38.9 | −42.1 | −20.3 | | |
| | | | Density | 1.32 (C) | | 1.19 (E) | 1.25 (C) | 1.35 (B) | 1.44 (A) | 1.19 (E) | | |
| | | | Density uniformity | 0.13 (E) | | 0.12 (E) | 0.12 (E) | 0.04 (B) | 0.01 (A) | 0.12 (E) | | |
| | | | Member contamination | C | | D | E | C | A | D | | |
| Low-temperature | Cold offset completion Temp. (° C.) | | | 140 (B) | 140 (B) | 140 (B) | 145 (B) | 160 (D) | 170 (E) | 140 (B) | 130 (A) | 155 (C) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-212261, filed Oct. 9, 2013, which is hereby incorporated by reference herein in its entirety.

What is claimed is:

1. A toner comprising:

a toner particle that contains a binder resin, wherein the binder resin contains a vinylic resin and a polyester resin, the vinylic resin contains an organic silicon polymer having a partial structure represented by the following formula (1) or the following formula (2):

formula (1)

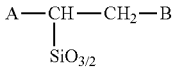

formula (2)

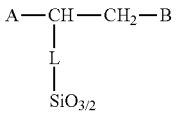

(wherein, A and B respectively and independently represent a partial structure represented by the following formula (3) or the following formula (4), and in formula (2), L represents a methylene group, ethylene group or phenylene group), formula (3)

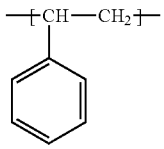

formula (4)

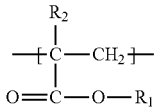

(wherein, $R_1$ represents a hydrogen atom or alkyl group having from 1 to 22 carbon atoms and $R_2$ represents a hydrogen atom or methyl group), a surface layer of the toner particle contains the organic silicon polymer, a proportion of a silicon atom in the organic silicon polymer having a structure represented by the $—SiO_{3/2}$ relative to a silicon atom in the organic silicon polymer contained in the toner particle is at least 5%, the polyester resin contains at least one polymer selected from the group consisting of polymers indicated in the following (i), (ii) and (iii):

(i) a polymer obtained by condensation polymerization of an alcohol component containing at least 50.0 mol % of an aliphatic diol having from 2 to 16 carbon atoms, and a carboxylic acid component containing at least 50.0 mol % of an aliphatic dicarboxylic acid having from 2 to 16 carbon atoms, (ii) a polymer obtained by condensation polymerization of an alcohol component containing at least 50.0 mol % of an aliphatic diol having from 2 to 16 carbon atoms, and a carboxylic acid component containing at least 50.0 mol % of an aromatic dicarboxylic acid having from 8 to 18 carbon atoms, and (iii) a polymer obtained by condensation polymerization of an alcohol component containing at least 50 mol % of an aromatic diol and a carboxylic acid component containing at least 50.0 mol % of an aliphatic dicarboxylic acid having from 2 to 16 carbon atoms, and the toner particle contains from at least 3.0% by mass to not more than 70.0% by mass of the polyester resin based on the binder resin contained in the toner particle.

2. The toner according to claim 1, wherein the polyester resin is a polyester resin having a melting point.

3. The toner according to claim 2, wherein the melting point of the polyester resin is from at least 40.0° C. to not more than 90.0° C.

4. The toner according to claim 1, wherein the polyester resin is a styrene-denatured polyester resin that has been denatured with styrene.

5. The toner according to claim 1, wherein a ratio of the density of a silicon atom dSi to the total density of the density of a carbon atom dC, the density of a hydrogen atom dH, the density of a silicon atom dSi and the density of a sulfur atom dS in a surface of the toner particle is at least 0.5 atom %.

6. The toner according to claim 1, wherein an average thickness Dav. of a surface layer of the toner particle that has the organic silicon polymer is from at least 5.0 nm to not more than 150.0 nm.

7. The toner according to claim 1, wherein a proportion of a portion where a thickness of a surface layer of the toner particle that has the organic silicon polymer is not more than 5.0 nm is not more than 20.0%.

8. The toner according to claim 1, wherein the organic silicon polymer is a polymer obtained by polymerizing an organic silicon compound having a structure represented by the following formula (5) or a structure represented by the following formula (6):

formula (5)

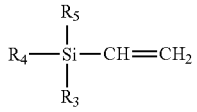

formula (6)

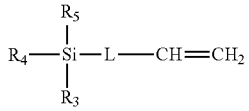

(wherein, $R_3$, $R_4$ and $R_5$ respectively and independently represent a halogen atom, hydroxyl group or alkoxy group, and in formula (6), L represents a methylene group, ethylene group or phenylene group).

9. The toner according to claim 8, wherein the alkoxy group is a methoxy group or an ethoxy group.

10. The toner according to claim 1, wherein the toner particle is produced by:

forming, in an aqueous medium, a particle of a polymerizable monomer composition: containing an organic silicon compound for forming the organic silicon polymer, a polymerizable monomer for forming the binder resin, and the polyester resin; and polymerizing the organic silicon compound and the polymerizable monomer.

* * * * *